US008033062B2

(12) United States Patent
Ferriere

(10) Patent No.: US 8,033,062 B2
(45) Date of Patent: Oct. 11, 2011

(54) TYPE OF BUILDING, METHOD AND MEANS FOR ERECTING IT

(76) Inventor: Christian Ferriere, Saint Hilaire de Brethmas (FR)

( * ) Notice: Subject to any disclaimer, the term of this patent is extended or adjusted under 35 U.S.C. 154(b) by 267 days.

(21) Appl. No.: 12/091,171

(22) PCT Filed: Oct. 27, 2006

(86) PCT No.: PCT/EP2006/067847

§ 371 (c)(1),
(2), (4) Date: Jun. 18, 2008

(87) PCT Pub. No.: WO2007/048836

PCT Pub. Date: May 3, 2007

(65) Prior Publication Data

US 2009/0300999 A1 Dec. 10, 2009

(30) Foreign Application Priority Data

Oct. 27, 2005 (FR) ..... 05 10960

(51) Int. Cl.
*E04H 1/00* (2006.01)

(52) U.S. Cl. ..... 52/79.9; 52/292; 52/294; 52/295; 52/296; 52/320; 52/321

(58) Field of Classification Search ..... 52/79.9, 52/292, 294, 295, 296, 320, 321, 322, 585.1, 52/583.1, 586.1, 293.2, 293.3, 169.9, 263, 52/264, 270, 223.7, 223.9, 274, 284, 745.13, 741.4, 252, 253, 259

See application file for complete search history.

(56) References Cited

U.S. PATENT DOCUMENTS

| | | | | |
|---|---|---|---|---|
| 2,438,604 | A * | 3/1948 | Gogerty | 52/263 |
| 3,613,325 | A * | 10/1971 | Yee | 52/236.8 |
| 4,147,009 | A * | 4/1979 | Watry | 52/742.15 |
| 5,007,218 | A * | 4/1991 | Bengtson et al. | 52/204.2 |
| 6,324,795 | B1 * | 12/2001 | Stiles et al. | 52/167.4 |
| 6,550,199 | B2 * | 4/2003 | Phillips | 52/294 |
| 6,584,740 | B2 * | 7/2003 | Record | 52/270 |
| 6,920,728 | B2 * | 7/2005 | Powers | 52/250 |
| 7,540,117 | B2 * | 6/2009 | Yang | 52/167.4 |
| 2001/0023563 | A1 | 9/2001 | Phillips | |

* cited by examiner

*Primary Examiner* — Brian Glessner
*Assistant Examiner* — Patrick Maestri
(74) *Attorney, Agent, or Firm* — Egbert Law Offices PLLC

(57) ABSTRACT

The residential building whose majority of components are prefabricated in a factory, includes a foundation supporting a bed, walls erected on the bed, a ceiling supported on the walls and a roof supported on the walls. The foundation is formed of foundation blocks that are cast on-site, in appropriate excavations, and joints by forms of stringers also cast on-site in appropriate excavations. Each foundation block is provided with a vertical pillar prefabricated in a factory, each vertical pillar having a horizontal upper planar face. The upper planer faces of the pillars are arranged along the same horizontal plane, receiving and supporting, at a distance from the ground, the bed of the building. The invention also relates to a method and device used for realizing the wall elements manually or automatically in a continuous manner.

33 Claims, 23 Drawing Sheets

TYPE OF BUILDING, METHOD AND MEANS FOR ERECTING IT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to the techniques used in the construction of residential housing.

More specifically, the subject of the present invention is a new type of building for which the majority of components, about 80% including the interior works, are prefabricated in a plant.

The subject of the present invention is also not only the means for manufacture of the components but also for erecting the building.

2. Description of Related Art Including Information Disclosed Under 37 CFR 1.97 and 37 CFR 1.98

Traditionally residential housings, such as individual homes or small condominiums, are constructed on site by assembling various construction materials. For the construction of the bearing or non-bearing walls, bricks or building blocks are used. For creating the building openings, prefabricated door and window frames are used. For the roofing, use is made of structural timbers such as prefabricated girders that have been adapted so they can support a roof cover consisting of tiles.

The construction of a residential building therefore requires several skilled workers that need to convene on the site in accordance with a pre-established scheduling which keeps track not only of the order in which these different skilled workers work but also of the duration of their individual activities.

This widely used mode of operation is subject, most of the time, to the uncertainties of weather which interrupt for shorter or longer periods of time particularly the construction of outside walls and the roof. These delays which are beyond anybody's control interfere with the scheduling plan by postponing the periods of activity of the different trades at the risk of one of them not being available at the required time.

The cost of construction is directly linked to the competence of the personnel employed as well as to the quality of the construction materials being used. Ordinarily the cost for labor and the contractor represents between 70 and 80% of the total cost whereas the materials represent only 20 to 30% of the cost of construction.

Another factor that affects the cost of construction is the level of protection against natural disasters which the construction can provide its occupants because of its design.

Those structures which can provide a high level of protection against fire, earthquakes, tornadoes etc. are especially expensive and consequently inaccessible to persons with modest incomes.

The in-plant manufacture of housing modules and their assembly on site is well known. The in-plant manufacture of these modules allows the builder to free himself of weather-related uncertainties and the caisson design of the various modules makes them highly resistant to natural disasters. However, this construction method offers few architectural variations thereby limiting the number of housing models that can be offered.

Also, the dimensions of each caisson are limited by the constraints imposed by the clearance limitations of road transport.

From prior art, one is also familiar with building manufacturing methods which consist of the erection of a bearing frame on a horizontal slab formed on site and of the fastening of prefabricated panels to this framework. The problem with this type of construction lies in the low resistance to earthquakes, unless metal frames are used.

One also knows from prior art, prefabricated buildings that are placed on foundations that are also prefabricated. Such a method can be illustrated in particular with the patent application US 2001/0023563 (PHILLIPS) concerning a permanent foundation for a prefabricated house. This permanent foundation consists of reinforced concrete beams with an upstanding T section put into the ground not in a grid, but parallel to each other at regular intervals. These girders are not joined to each other and cannot confer to the foundation all the rigidity it needs to have.

From the Australian application AU 27958 (SIGAL), one is also familiar with a building that comprises a peripheral foundation and some pads 11 that are implanted in the soil within the space demarcated by the foundation. But these pads are not connected to the peripheral foundation and cannot form together with the latter a rigid grid all in one piece. Such an arrangement is not apt to form an anchorage in the ground that is dimensionally stable and capable of resisting the weight load represented by the building and capable of mechanically resisting any seismic shocks.

From the U.S. Pat. No. 6,085,432 (VAN DER SLUIS) one also knows a positioning device that provides a certain orientation to an upright that is designed to receive a pylon. This device is not suitable for placing the upper face of the upright in the horizontal position.

BRIEF SUMMARY OF THE INVENTION

The aim of the present invention is to mitigate the aforementioned problems by providing a building, the components of which are in large part prefabricated in a plant and which are assembled on site in order to reduce the building costs and to be independent of weather-related uncertainties.

A further goal of the present invention is to provide a building that is capable of resisting natural disasters without additional expenditures for construction.

Another goal of the present invention is to provide a building the elements of which can be assembled on site without the traditional know-how, by using methods and tools that are adapted to the prevailing conditions on site.

Another aim of the present invention is to considerably reduce the length of time needed to construct the building.

A further aim of the present invention is the integration at a level equal to at least 80% of the interior construction.

For this purpose, the residential housing building in particular whose components are mostly prefabricated, including a foundation that supports a building slab, walls erected on the slab, a ceiling supported by the walls and a roofing structure supported by the walls. The foundation is constituted of foundation blocks that are poured on site in appropriate trenches, rigidly linked by shapes of longitudinal ties also poured on site in appropriate trenches. Each foundation block is equipped with a vertical prefabricated pillar with a horizontal upper plane face, the upper plane faces of the various foundation pillars all being positioned in the same horizontal plane above the ground and bearing, away from the ground, the building slab and each vertical pillar being rigidly attached to the foundation block that supports it.

The shapes of longitudinal ties will be arranged in a mesh of rows and columns, the blocks being positioned at the intersection of such rows and columns. The different elements of this foundation (ties and blocks) are solidly interconnected and form a rigid whole of one piece anchored in the ground, being capable of spreading the loads and of withstanding seismic shocks without breaking.

An advantage of this arrangement is to keep the construction base away from the ground. In this way a sanitary space is created between the ground and the construction base. Another advantage of this arrangement is that it limits the extent of the contact areas between the ground and the base so one can dispose, at the level of these mechanical contacts, of means to limit and absorb the seismic energy that is likely to be transmitted by the ground.

According to another characteristic of the invention the pillars are placed on site and put at adequate height before the shapes of longitudinal ties and the foundation blocks are poured.

In this way, the prefabricated pillars can be cast-in, in their lower area, into the concrete, constituting the blocks which support them.

In order to strengthen the anchorage of the pillars to their blocks, the metal reinforcement (re-bars) inside each pillar, according to another aspect of the invention, emerges vertically from the lower face of the pillar to be cast in the concrete of the corresponding block. In this way a particularly sturdy attachment of the pillars to their blocks is obtained.

According to another characteristic of the invention, the base plate is constituted by a base frame arranged as a grid and by a floor resting on the base frame and rigidly attached to the latter. The base frame consists of prefabricated, prestressed longitudinal ties resting at their ends on the vertical pillars, being interconnected at their ends, and the floor consists of a stone floor in a meshwork including anchorage that is itself arranged in grid form, the anchorage being rigidly attached both to the stone floor and to the base frame. The meshwork of the base frame and the meshwork of the floor are being in correspondence with each other. This arrangement gives the base high rigidity and high mechanical strength.

The meshwork formed by the base frame comprises rows and columns at the intersection of which the foundation pillars are placed. The meshwork represented by this base is thus superposed over the grid which forms the foundation. In this manner, two rigid and strong grids are placed one on top of the other.

According to another characteristic of the invention, the flooring plate of the floor is formed by the juxtaposition of prefabricated, self-supporting, re-enforced plates that are arranged in meshwork and by a meshed anchorage the loops of which are peripheral to those of the flooring plate and attached to the latter.

According to another characteristic of the invention, each slab forming the floor comprises along one of its longitudinal edges a longitudinal structural rebate that is meant to receive, following the abutment of the slabs, a reinforcing and linking anchorage constituted by concrete and an internal metallic reinforcement (re-bar) presenting itself in the form of a rod, with said anchorage being linked to the peripheral anchorage of the floor.

According to another characteristic of the invention, the metallic reinforcement in the form of a rod extends over the two end faces of the longitudinal tie to become integral with the peripheral anchorage included in the floor, this anchorage being poured on site.

According to another characteristic of the invention, each slab has on one of its longitudinal edges a kind of tongue and on the opposite edge a kind of groove.

With such a disposition the slabs are assembled together by engaging the tongues in the grooves. Such an arrangement strengthens the connection of the different slabs to each other.

According to another characteristic of the invention associated with the floor are inner-partition elements which are covered on their inside face to the building with a cold insulation, the elements and the insulation on the one hand and the opposite slab edge faces on the other hand constitute the lateral flanks of the formwork of the anchorage of the floor.

The advantage of this arrangement lies in the utilization of actual construction elements for execution of the formwork of this anchorage.

According to another characteristic of the invention, the floor anchorage is rigidly connected to the base frame, in particular to the concrete, ensuring the connection of the longitudinal ties among themselves.

According to another characteristic of the invention, the connection between the longitudinal ties of the base frame and the peripheral anchorage of the floor is obtained by one single pouring of concrete.

In this manner one obtains a mono-block assembly, constituted by the base frame and the floor, presenting an especially high degree of solidity and this without the formation of a thermal bridge.

For regions where the risk of earthquakes is low or nonexistent, the two rigid assemblies which constitute the foundation and the base may be rigidly connected one to the other.

So, according to another aspect of the invention, each pillar contains a vertical reinforcement in readiness, emerging from its upper face, intended to be lodged in the gap between the end front faces of the prefabricated longitudinal ties, and each prefabricated, prestressed longitudinal tie is provided with internal, longitudinal metal reinforcement emerging from its frontal faces arriving also in the afore-mentioned gap which eventually is filled with bonding concrete.

One obtains thus a particularly rigid connection between the base frame formed by the longitudinal ties and the support pillars.

But for regions where the risk of earthquakes cannot be neglected, the invention in accordance with another of its aspects provides for the interposition between the pillars and the base frame of mechanical isolating devices suitable for limiting or suppressing the spread of seismic waves from the ground to the construction.

According to a first form of execution, each isolating device consists of a metallic, horizontal base plate integral with the upper face of the corresponding pillar, and a side friction block in sliding support on the base plate and integral with the base frame.

Such an arrangement filters the horizontal seismic vibrations between the foundation and the base frame, but does not filter the vertical vibrations.

According to another characteristic of the invention that aims to resolve the afore-mentioned problem, the isolating device consists of an elastomer pad sandwiched between two horizontal metallic plates one of which is made integral with the corresponding pillar and the other with the base frame. Such an arrangement isolates only partially the base frame as far as the horizontal components of a seismic wave are concerned and softens the vertical components of this wave.

According to another variant execution of the isolating device, the latter is composed of a combination of the two preceding devices.

According to another characteristic of the invention, the building walls are formed on the base and are constituted by abutment and assembly of prefabricated wall panels.

According to another characteristic of the invention, plane facade panels are used, and possibly angled panels in the form of dihedrons.

According to another characteristic of the invention, the facade and angled panels each include a rigid, horizontal lower compression plate and internal reinforcement which is mechanically linked to the compression plate and includes several elongated elements extending in vertical anchorage housing which are vertically placed in the panel, with at least one of these reinforcement elements extending above the upper edge of the panel and being fitted above said edge, as a handling and lifting device.

According to another characteristic of the invention, each prefabricated wall panel includes in its lower part a rigid bearing and support plate which is mechanically connected to a re-bar extending vertically in the wall and to which re-bar, in the upper part of the wall, at least one lifting and shipping tie rod is rigidly attached.

Because of this disposition, the hoisting effort will be transmitted to the rigid compression plate by the internal reinforcement re-bar in the wall panel.

According to another characteristic of the invention, the compression plate is made of reinforced concrete and the wall panel is created by assembling construction blocks on the compression plate.

According to another characteristic of the invention, the horizontal feet protruding laterally in relation to one of the large wall panel faces are attached to the rigid compression plate of each wall panel, said wall panel being attached to the floor more particularly by these feet.

According to another characteristic of the invention, the wall panels are attached to the floor by glueing their base to the anchorage of the floor. To obtain this bond, an adhesive mortar is used preferably.

The point of these last two arrangements is to allow a fast attachment of the wall panels to the floor, in an operation which does not require the traditional know-how.

According to another characteristic of the invention, the wall panels are connected to each other by a mechanical assembly of their reinforcement re-bars on both sides of their mating surfaces and by glueing along their vertical abutting edges.

According to another characteristic of the invention, the wall panels are assembled in their upper part by a continuous horizontal anchorage, the protruding reinforcement elements on the upper edges of the panels being tied into this anchorage.

According to another characteristic of the invention, each vertical edge of each panel features a continuous vertical groove running over the entire height of the panel, this groove receiving against its bottom face one of the reinforcement elements of the panel, this element being attached to the bottom face of said groove.

According to another characteristic of the invention, in areas of significant seismic risk, the connection between the panels is reinforced by concrete being poured in the compartments formed each by the anchorage grooves of two adjacent panels so as to create a wedging. In this hypothetical case, the grooves will be deeper.

This bonding concrete attaches itself to the peripheral anchorage of the floor thereby further strengthening the mechanical connection of the panels at the base of the construction.

According to another characteristic of the invention, for panels with an opening such as a door, window or French window, the lintel of the frame of said opening presents a U-section and forms a horizontal anchorage volume intended to receive a reinforcement and a concrete, said reinforcement penetrating by its two ends into the two vertical anchorage recesses which the panel presents. Such an arrangement is primarily intended for buildings that are put up in earthquake-prone areas.

The take-up of the anchorage of the lintel in the other two vertical anchorages of the panel tends to strengthen the framing of the opening.

According to another characteristic of the invention, in order to form the corners of the construction, corner panels are provided which present the same characteristics as the flat panels, this corner panel forming a dihedral angle presenting furthermore a vertical anchorage volume that is at a right angle to the peripheral anchorage of the floor, this volume of anchorage receiving a fastener to the peripheral anchorage of the floor.

According to yet another characteristic of the invention, the various corner panels or wall fronts are each provided, along their upper edge, with a horizontal recess which joins the two lateral recesses they each have, said horizontal recess constituting a horizontal volume of anchorage into which the fasteners penetrate that are installed in the vertical volumes of anchorage formed by the lateral recesses.

According to another characteristic of the invention, at least one of the wall panels presents a vertical cutout in which a power line or a wastewater pipe is installed.

According to another characteristic of the invention, the bearing ceiling, resting on the walls and attached to the latter, consists of a meshed slab formed by juxtaposition of prefabricated plates and attached to each other and by a reinforced meshed anchorage forming rigid frames around and in the slab, said slab being attached to said anchorage.

According to yet another characteristic of the invention, the ceiling slab organized along the mesh is formed by prefabricated assembly of ceiling plates, presenting each along one of their longitudinal vertical edges a tenon and along the opposite longitudinal edge a mortise, the different plates being attached to each other by fitting the mortises of the ones into the tenons of the others, said plates resting on a frame formed by abutment of wall panels of small height.

According to another characteristic of the invention, each ceiling plate, perpendicular to the tenon, includes a longitudinal rebate intended to receive, after assembly of the plates, a reinforcing anchorage formed of concrete and steel reinforcement in lateral overlap to be taken up in the horizontal peripheral anchorage at the ceiling.

According to another characteristic of the invention, the self-bearing roofing is formed by glued assembly along their lateral edge of prefabricated self-bearing roofing plates, the roofing slab being mechanically connected to the anchorage of the floor and an anchorage formed along the upper surfaces of the gable wall.

As a variant, according to another characteristic of the invention, the roofing framework is formed by small prefabricated girders and the ceiling is formed by plaster slabs suspended from the framework.

In this hypothetical case, the peripheral anchorage which allows connecting the bottom part of the construction, by creating an upper belt, will be established by blocks of cellular concrete presenting an anchorage channel in which an appropriate reinforcement is placed and concrete is poured.

According to yet another characteristic of the invention, the different components of the building are assembled to each other by a continuous anchorage forming a framework.

Such a building constructed in this manner is particularly sturdy and its walls can now be built on a perfectly horizontal base by virtue of the adjustment of the height of the pillars before the foundations are poured, the reason for such an arrangement is to ensure the surface evenness and the horizontal position of the base even in the event that the foundation is not level.

The present invention is relative also to a manufacturing process of wall panels of the building according to the invention. This process consists essentially of manufacturing a continuous wall pane by assembly, blocks in successive rows and to make vertical cuts in the wall pane in order to divide it into wall panels.

According to another characteristic of the method according to the invention, the building blocks are assembled by glueing.

According to another characteristic, the method according to the invention consists of the height calibration of the wall pane, before the vertical cuts are made.

According to another characteristic, the method according to the invention consists of making the anchorage channels and bore holes for handling in the panes, after cutting the panes (into panels).

The invention is also relative to an installation for the implementation of the method defined above. The installation includes a mobile linear conveyor facing a block glueing and assembling station, a height calibration station, a wall panel cutting station, a lateral grooving station, an angle grooving station and a panel drilling station for their handling.

The subject of the present invention is also installation equipment for the prefabricated elements.

Thus, in accordance with another characteristic of the invention, each prefabricated pillar is placed by using an adjustable support comprising a pillar holding structure, in the form of a sheath, said structure being mounted on at least three height-adjustable feet.

Finally, another advantage related to the building mode is the manufacture of the building components, in hidden time, during the drying of the foundation, the adequate duration of drying being approximately one month.

BRIEF DESCRIPTION OF THE SEVERAL VIEWS OF THE DRAWINGS

Other advantages, goals and characteristics of the invention will become apparent when reading the description of a preferred form of execution given on a non-limiting basis, by referring to the attached drawings.

DETAILED DESCRIPTION OF THE INVENTION

Figure 1:
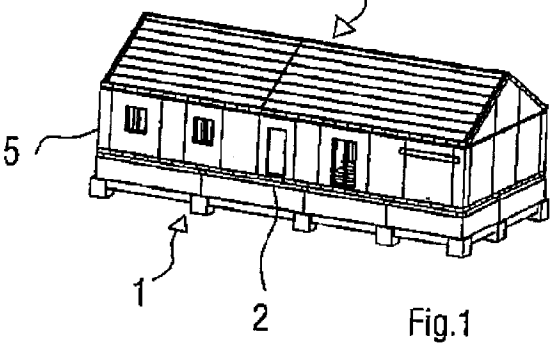
FIG. 1 is a perspective view of a building according to the invention, with roofing according to a first form of execution.
Figure 2:
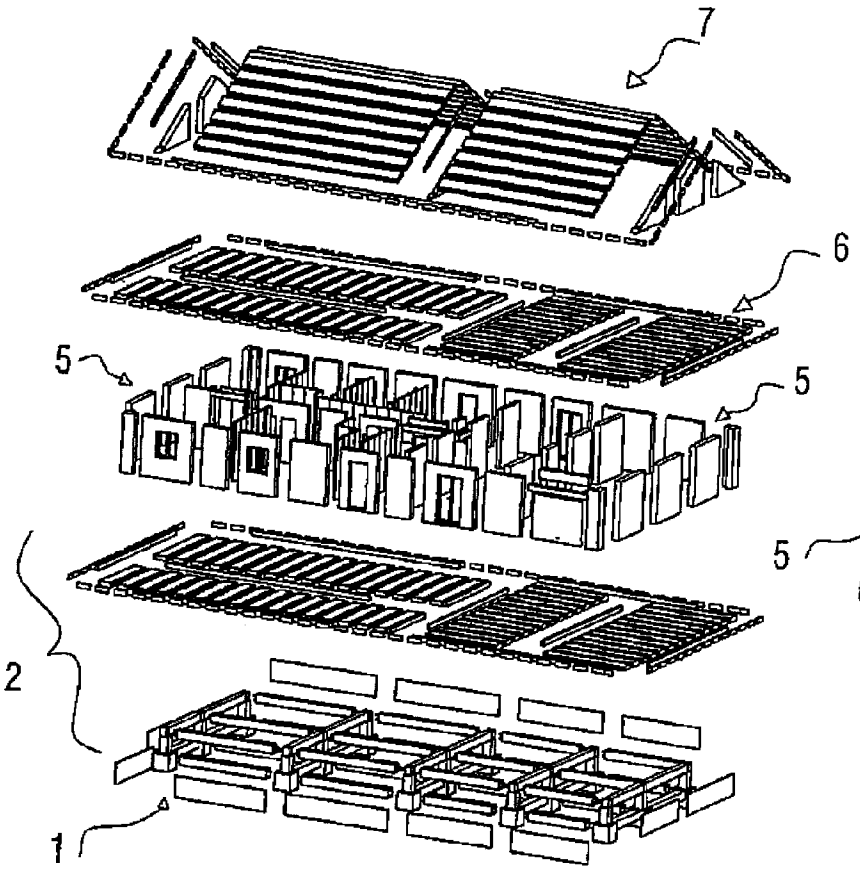
FIG. 2 is an exploded view of the building shown in FIG. 1.
Figure 3:
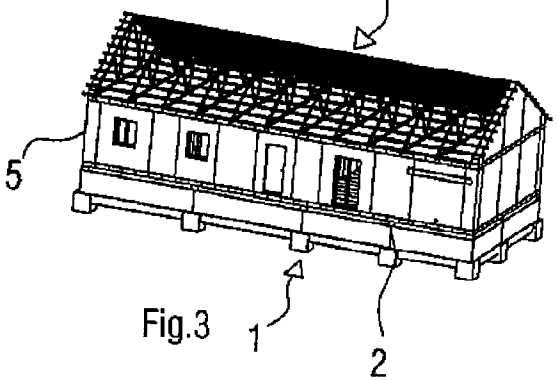
FIG. 3 is a perspective view of a building according to the invention, with roofing according to a second form of execution.
Figure 4:
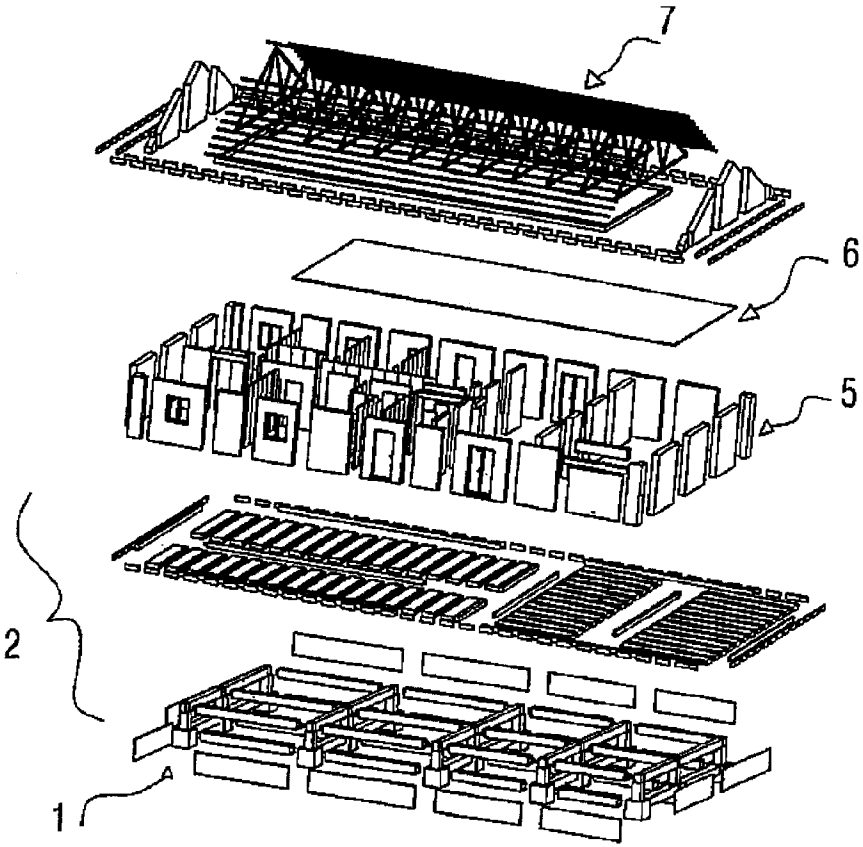
FIG. 4 is an exploded view of a building according to FIG. 3.
Figure 5:
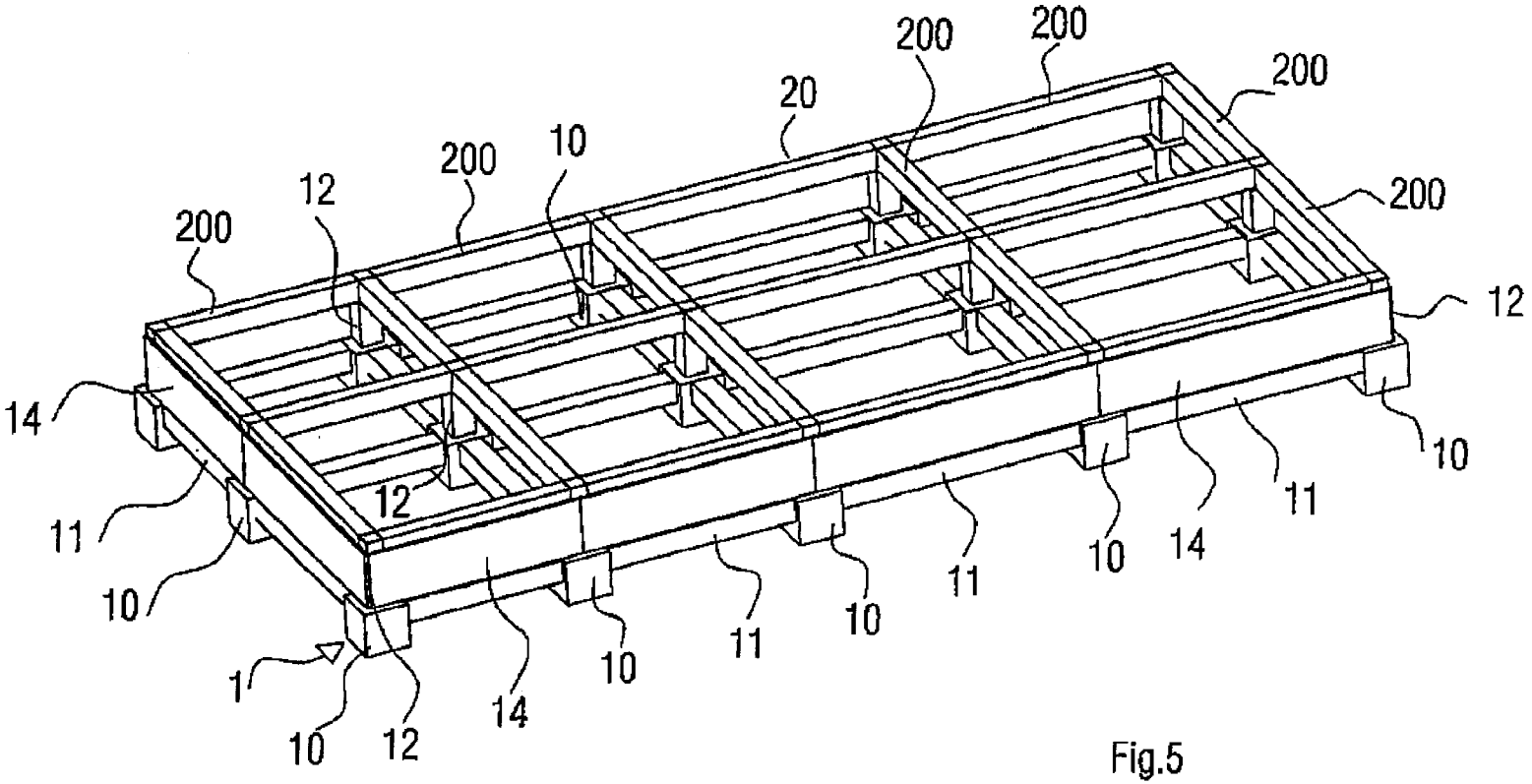
FIG. 5 is a perspective view of the foundation and the base frame of the base of the building.
Figure 6:
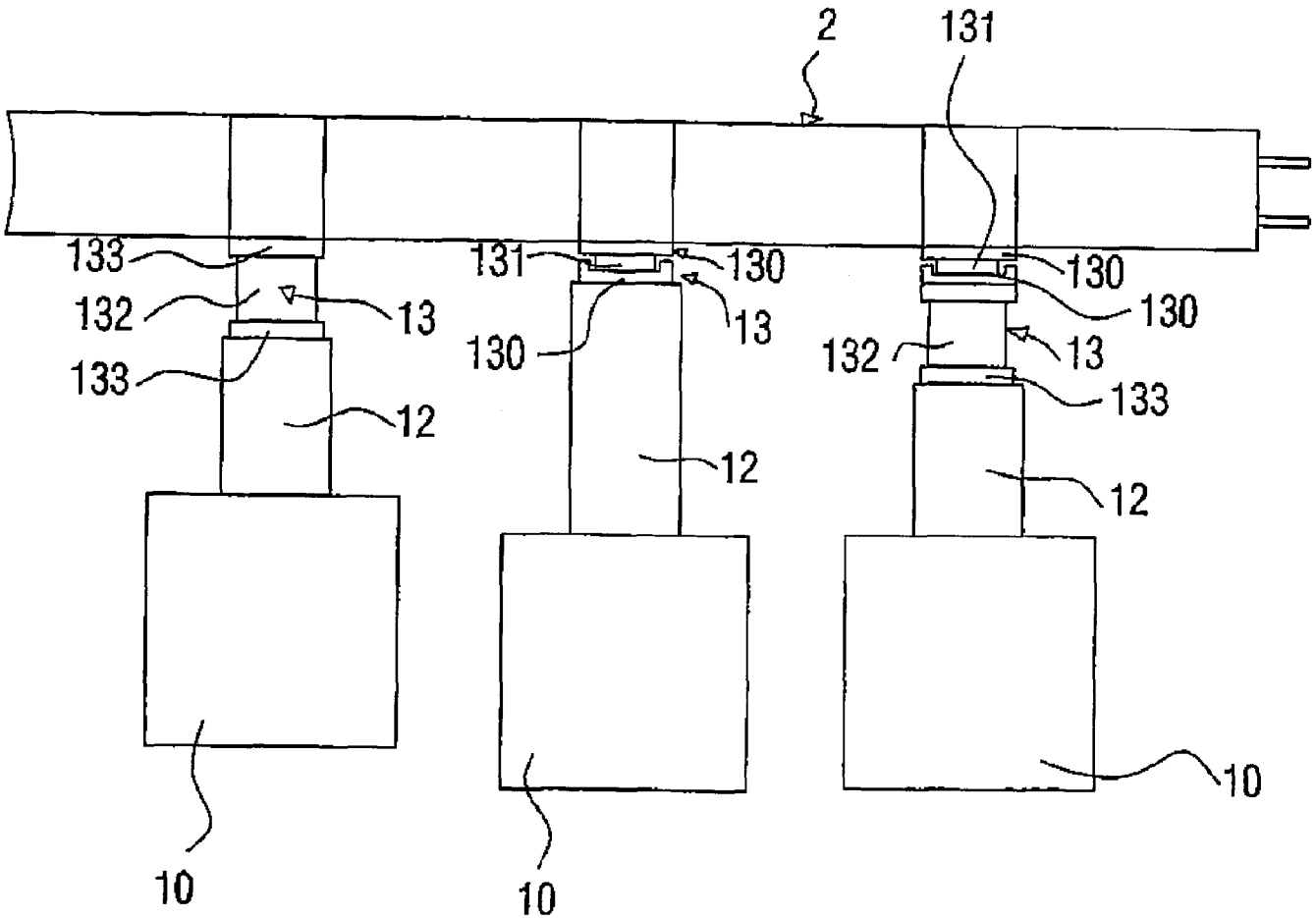
FIG. 6 shows the different forms of execution of the means to isolate the foundation from the base.
Figure 7:
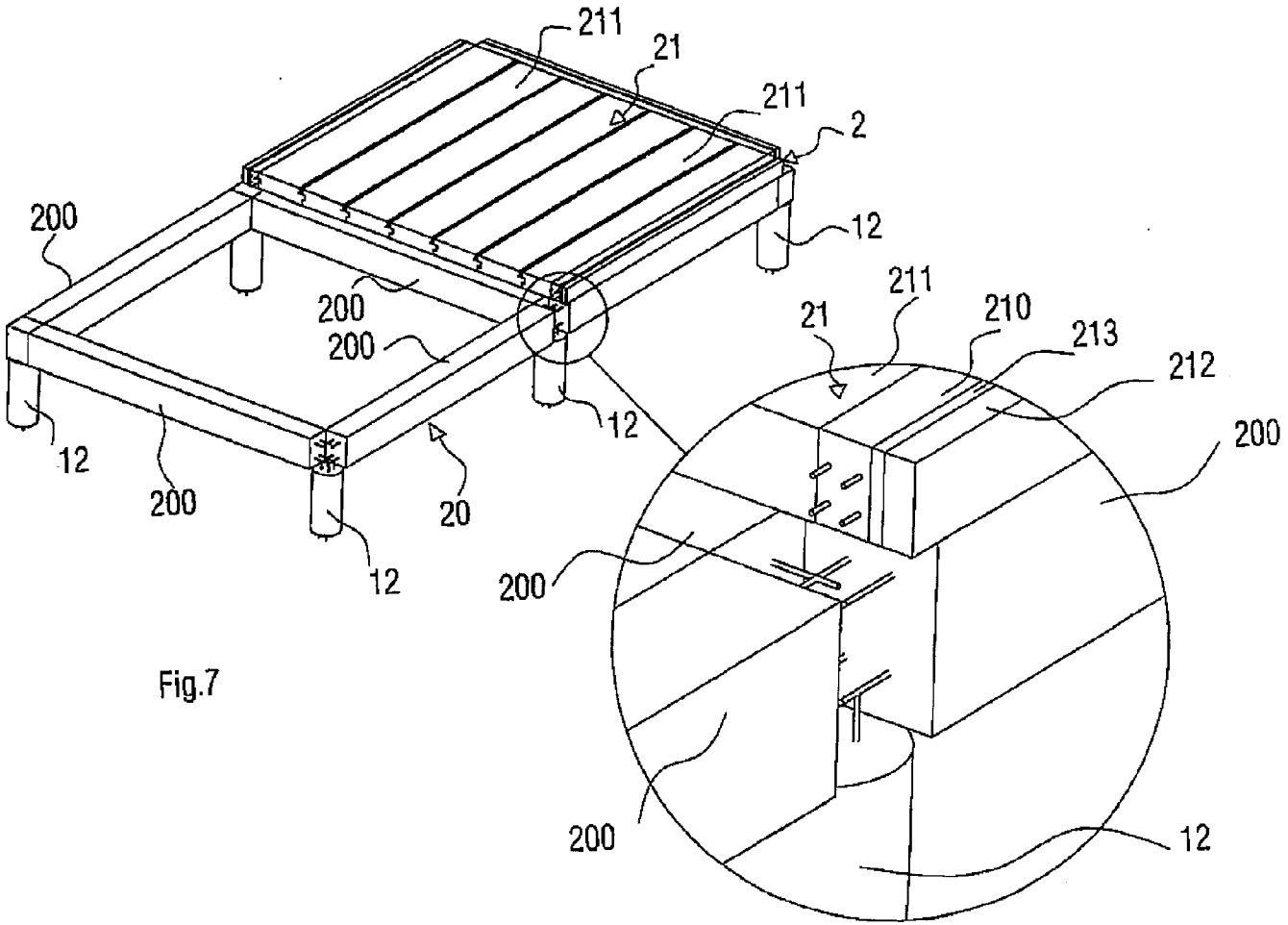
FIG. 7 is a perspective view of the base of a building.
Figure 8:
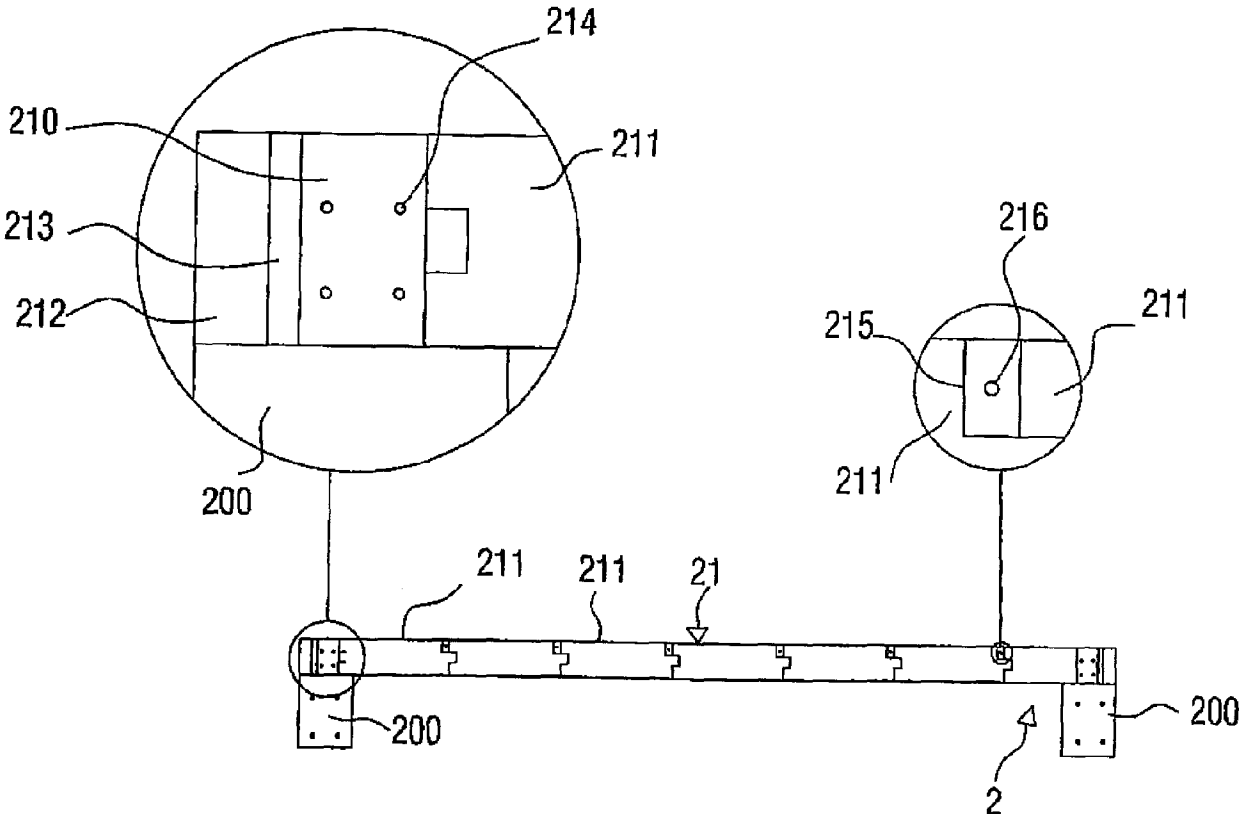
FIG. 8 is a cross-sectional view of a drawing of a base showing the detail of the floor of the latter.
Figure 9:
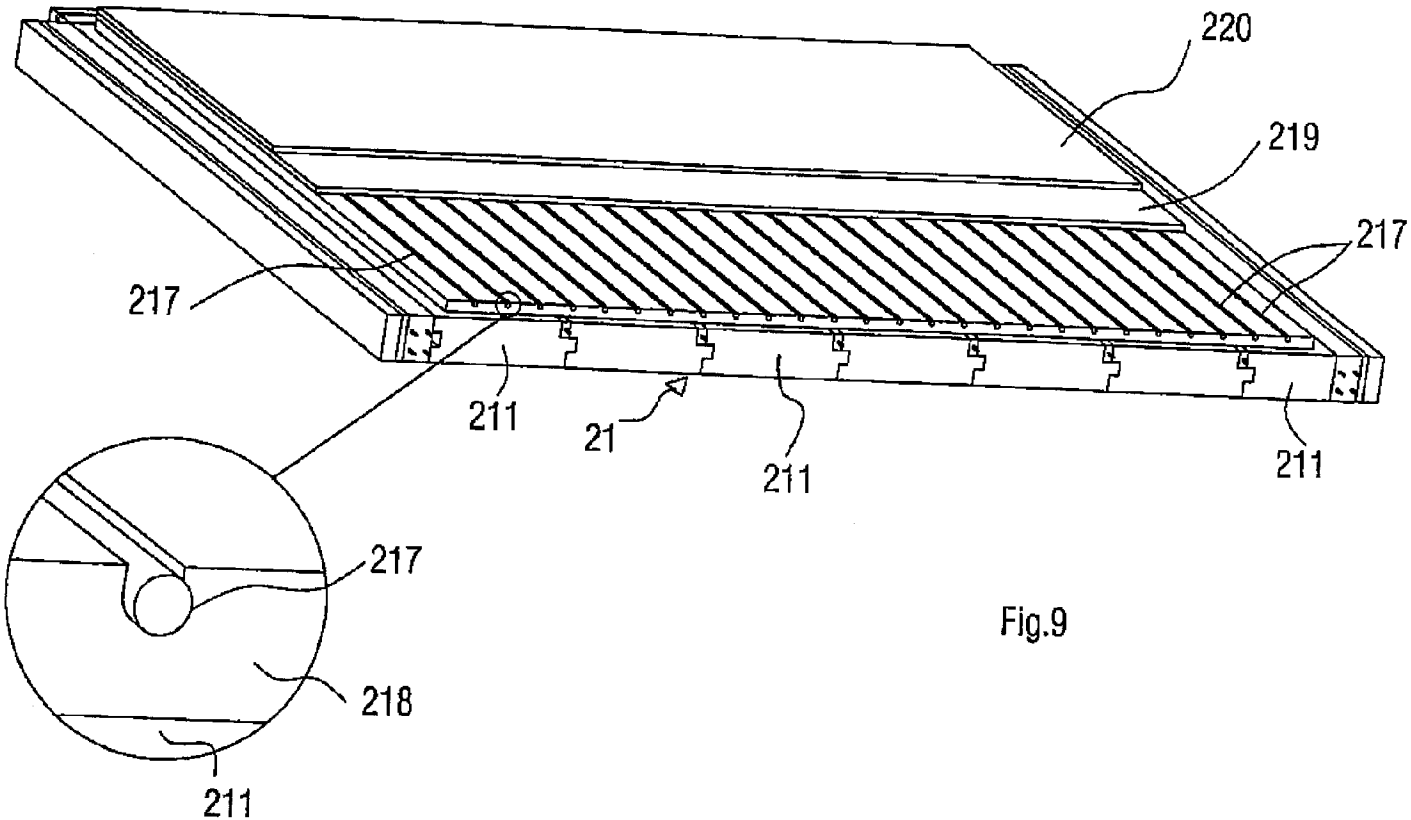
FIG. 9 is a perspective view of a floor with the means of floor panel heating.
Figure 11:
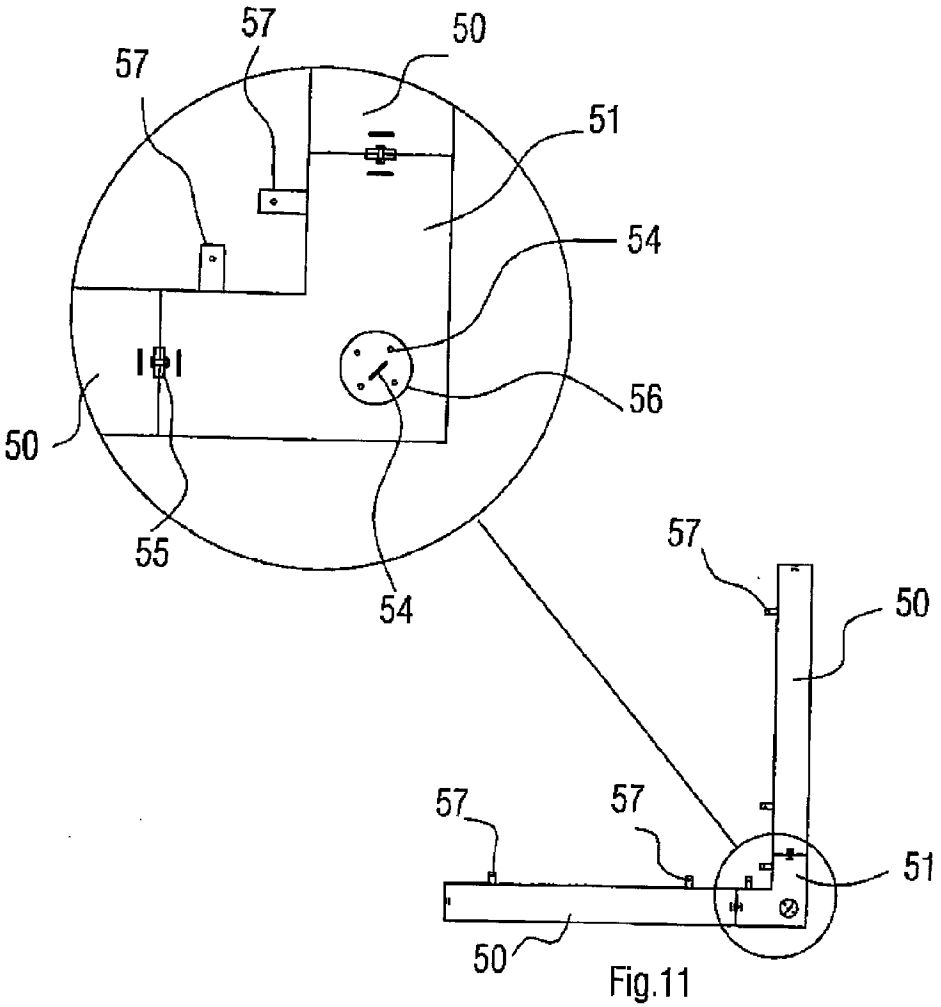
FIG. 11 is a detailed top plan view of the assembly according to FIG. 10.
Figure 10:
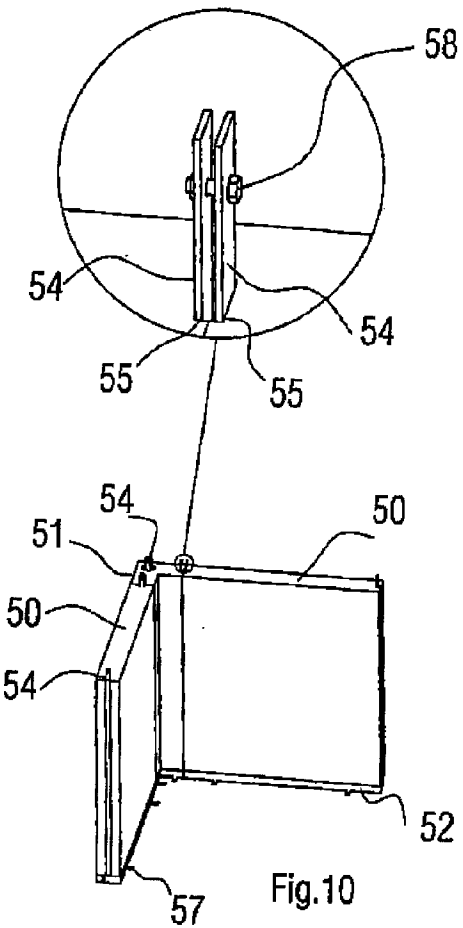
FIG. 10 is a perspective view of the assembly of two facade panels to an angle panel.

As shown, the building according to the invention includes a foundation 1 on which, away from the ground, a building base 2 is installed, supporting walls 5 on which a ceiling structure 6 and roofing 7 are installed, these different components, aside from certain elements of the foundation, being prefabricated in a plant.

Foundation 1 includes blocks 10 which have been poured in trenches made in the soil, are joined by longitudinal ties 11 that have also been poured in trenches made in the soil, the blocks 10 being equipped with prefabricated vertical pillars 12 on which rests the building base 2, the vertical pillars 12 being rigidly integral with the blocks which support them.

The blocks 10 and the longitudinal ties 11 are arranged in a four-sided grid comprising rows and columns that are perpendicular to each other. The columns and the rows are formed by the longitudinal ties; the blocks are formed at the intersection of the rows and columns.

Between the base and the longitudinal ties, it is possible to position inner partition elements to close off the crawl space created under said base.

Each pillar 12 has internal rebars of which at least one end is outside of the pillar and forms a lower reinforcement on hold. The other end can also be outside of the pillar and form an upper reinforcement on hold.

The upper plane faces of the pillars 12 are placed in a single horizontal base plane place above and at a distance from the ground.

The base 2 rests on the upper face of the pillars 12 either directly or through the intermediary of means 13 of mechanical isolation capable of suppressing or limiting the propagation of seismic waves.

In case the base must rest directly on the pillars 12, a rigid attachment of the latter to the base will be established. In this hypothetical case each pillar 12 will include the upper reinforcement bar or rebar on hold by which it will be fastened to the base as described further down.

According to a first form of execution, the means of isolation is constituted by two horizontal base plates 130 made of steel, that are integral respectively with the upper face of the pillar 12 and the base 2, and with a side-friction block 131 made of bronze that is placed between the two steel plates.

According to another form of execution, the means of isolation 13 are constituted by an elastomer block 132 serving as a shock absorber sandwiched between two metallic plates 133 that are integral with the pillar 12 and the base 2 respectively.

One can also provide a means of isolation 13 consisting of the combination of the preceding means, that is to say by steel plates 133 holding between them a shock absorber 132, with one plate being attached to the upper face of the pillar 12 and with the other one receiving the sliding support of a side-friction block 131 in bronze on which rests a steel plate 130 which is attached to the base 2.

The base 2 is constituted by a base frame 20 arranged in a grid pattern and by a floor 21 resting on the base frame 20 and rigidly fastened to the latter.

The base frame 20 is constituted by prefabricated, pre-stressed longitudinal ties 200, resting at their ends on the vertical pillars 12 either directly or through the intermediary of means of isolation. The ties are fastened to each other at their ends. As one can see, the longitudinal ties 200 are arranged in a grid which strengthens the mechanical strength of the base.

Each of these longitudinal ties contains a pre-stressing steel armature, jutting out of its frontal face in order to form reinforcement on hold.

By these reinforcements and concrete, several adjacent longitudinal ties 200 are attached to each other.

In the case where these longitudinal ties 200 rest directly on the pillars 12, the rebar contained in the latter are also covered in the bonding concrete of the longitudinal ties 200. In this manner, the fastening of the base to the pillars 12 is assured.

The floor 21 is supported by the base frame and is integral with the latter.

This floor consists of a slab that is associated with the meshed anchorage 210 that is connected to the slab on the one hand and to the concrete bonding the longitudinal ties among each other on the other hand The slab perpendicular to the grid of the base frame 20 is constituted by assembly of plates 211 that are each provided along their longitudinal edges with a tenon and a mortise, the assembly of the plates 211 being achieved by fitting together the tenons and the mortises as well as glueing. One will notice that this assembly of slabs 211 constitutes a floor grid containing a peripheral anchorage with armature 214. It should be noted that the anchorage 210 of the floor 21 is formed between the slab and external elements of inner partitions 212. Each are covered along their inner face to the building with a thermal insulating material 213. These elements of inner partitions and their insulating material prevent the thermal bridge between the anchorage and the outside of the building.

Each slab 211 includes along one of its longitudinal edges a receptacle 215 which forms, by abutment with another slab, a volume of anchorage. An armature 216 is placed in the form of a concrete reinforcing bar, and concrete is poured. The concrete reinforcing bar extends over the lateral faces of the slab to be joined to in the anchorage of the floor.

The slabs 211 can each be equipped with a tenon and a mortise for joining.

The floor 21 of the building can accept, after it has been boxed up, floor panel heating of the low temperature type which can include cellular circulating conduits 217, for instance in polyethylene, that are implanted in a preformed insulating material 218 that is placed directly on the slab. These conduits are provided to be then connected to a unit heating station installed in an appropriate location in the building. These conduits 217 are intended to convey a heat-transfer fluid, such as water for instance.

Floor plates 219 placed on top of the insulating material 218 provide protection of the floor heating installation, as these protection plates can receive a facing of the tile type 220. Advantageously these floor plates 219 will be attached in a removable manner, by screws for example, so that they can be easily removed to grant easy access to the circulating conduits 217.

The walls are formed by assembly along their vertical edges of plane shaped prefabricated panels 50 as far as the facades are concerned and possibly in the shape of right angle 51 with respect to the corners of the building.

Each wall panel 50, 51 includes, according to a first form of execution, a horizontal lower rigid support footing 52 on which, along three or four of their faces, construction blocks 53 are assembled by glueing and arranged in successive courses.

The rigid footing 52 can be made of reinforced concrete.

Preferably the footing, on its outer face to the building receives an element of interior partition made of cellular concrete which is lined with a thermal insulation material. In this way, one avoids any thermal bridge on account of the presence of the footing.

Each wall panel features an internal reinforcing armature that is mechanically connected to the bearing footing 52. This reinforcement includes several elongated elements 54 which extend into vertical recesses of anchorage formed in the panel along its entire height or along most of its entire height. These elements 54 or certain ones among them receive above the upper edge of the panel a handling device in the form of an eye bolt.

The vertical anchorage recesses can be constituted by channels 55 made in the vertical edges of the panel and/or by vertical cylindrical shafts placed in the heart of the panel.

The wall panels 50, 51 are by their footing 52 bearing down on the peripheral anchorage of the floor 21 and are attached to this floor 21 by a bond through adherence and by a bond through friction.

The bond through adherence is realized by glueing of the lower edge of each panel 50, 51 to the floor 21, and the bond through friction is realized by fasteners, nails for instance, that are engaged on the one hand in drill holes created in the horizontal feet 57 that are integral with the support footing 52, and on the other hand in the floor slab.

The wall panels 50 and 51 are connected to each other by glueing of their respective vertical edges but also in upper areas, above their horizontal edges, by the mechanical connection of their armatures.

In this regard, the reinforcement elements 54 lodged in the vertical channels 55 will be connected in their upper part 58 by bolts or weldments.

Each element of reinforcement 54 can consist of a flat iron fastened by studding in the channel 55 and taken up in the footing 52.

Figure 12:
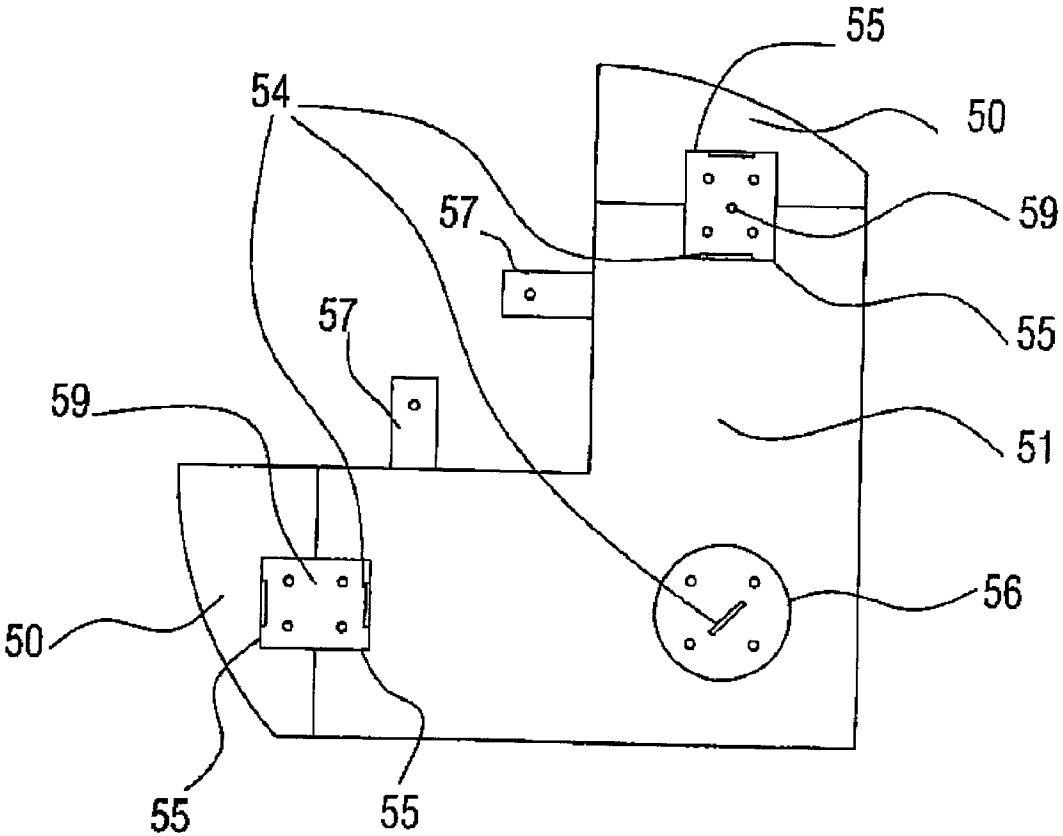
FIG. 12 is a detailed top plan view of the assembly of two facade panels to an angle panel for earthquake-prone areas.
Figure 14:
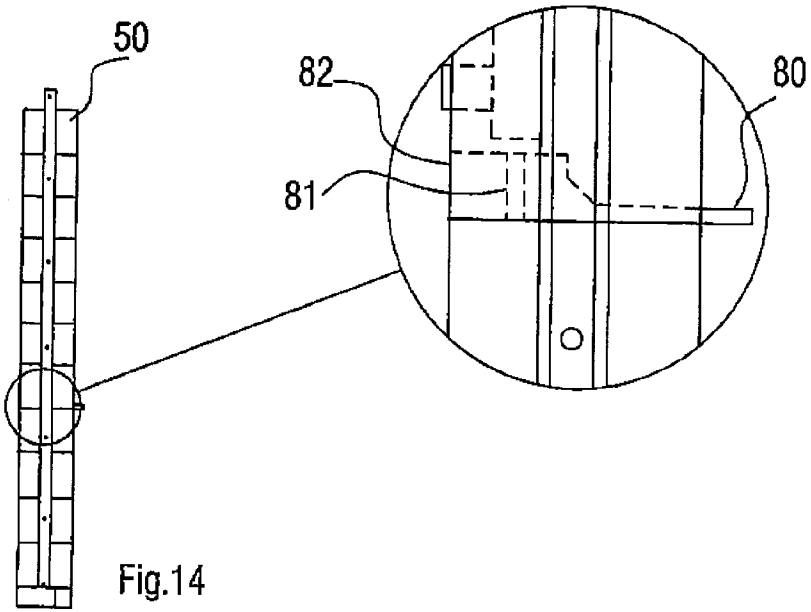
FIG. 14 is a sectional view along the line AA of FIG. 13.

In FIG. 12, one can see that by abutment of the wall panels 50, 51 on either side of each abutment plane a recess formed by two vertical channels 55 facing each other. To strengthen the connection between the wall panels, reinforcement in the form of a re-bar is placed in this recess and concrete is then poured into the latter. In this manner, a reinforced connecting key 59 will be created between two adjacent panels.

The wall panels will be connected in their upper part by an anchorage that runs along their upper horizontal edge. In this anchorage, the upper overlapping parts of the reinforcement elements 54 of the panels 50, 51 will be joined.

Figure 13:
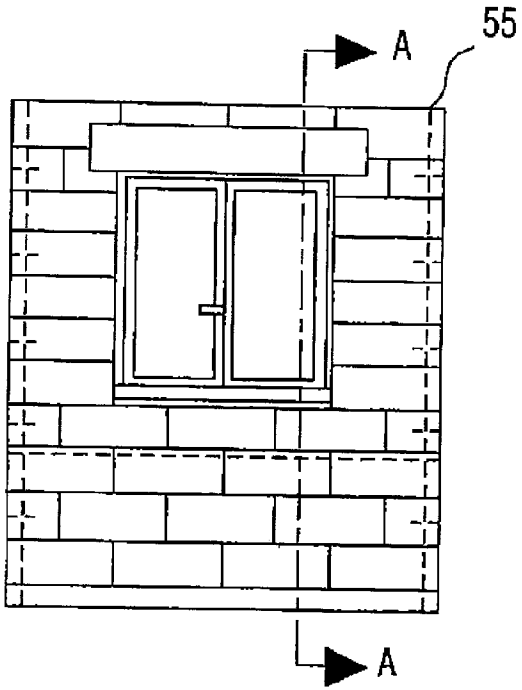
FIG. 13 is an elevational view of a panel with a window-type opening.
Figure 16:
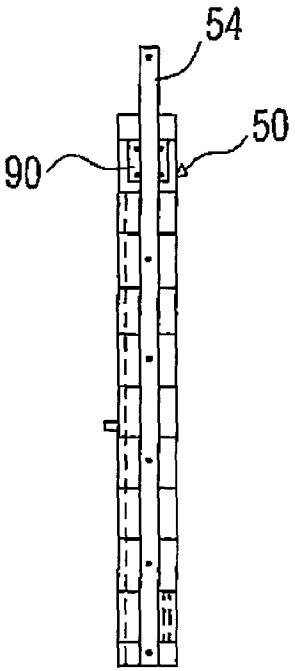
FIG. 16 is a sectional view along the line AA of FIG. 15.
Figure 15:
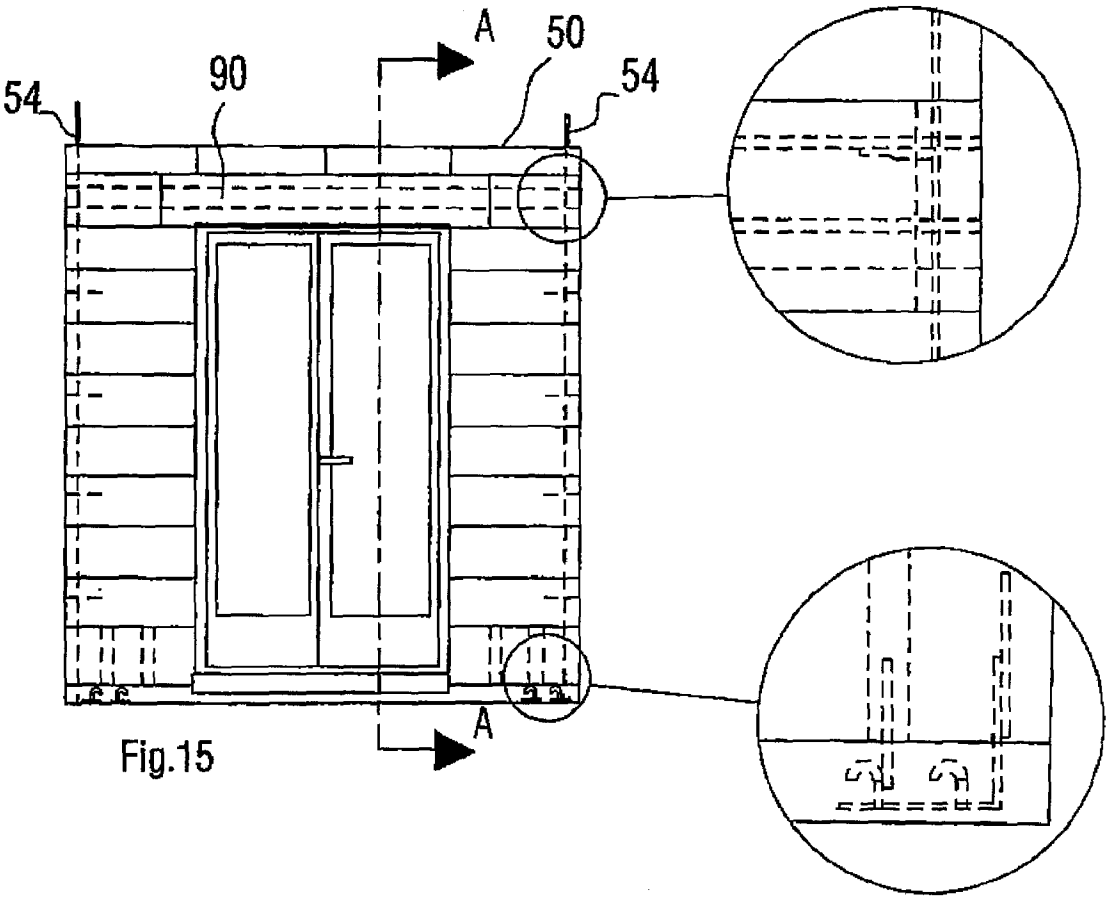
FIG. 15 is an elevational view of a panel with a French-window type opening.
Figure 17:
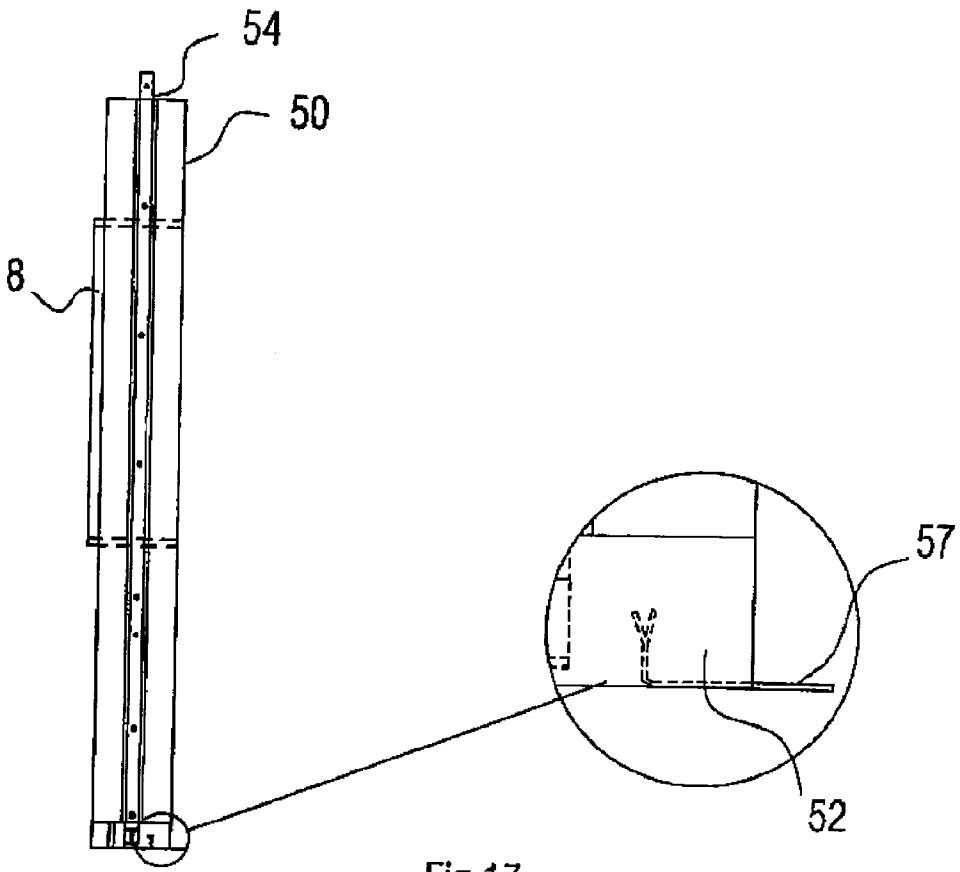
FIG. 17 is a side-face elevational view of a wall panel with means of fastening to the floor.
Figure 19:
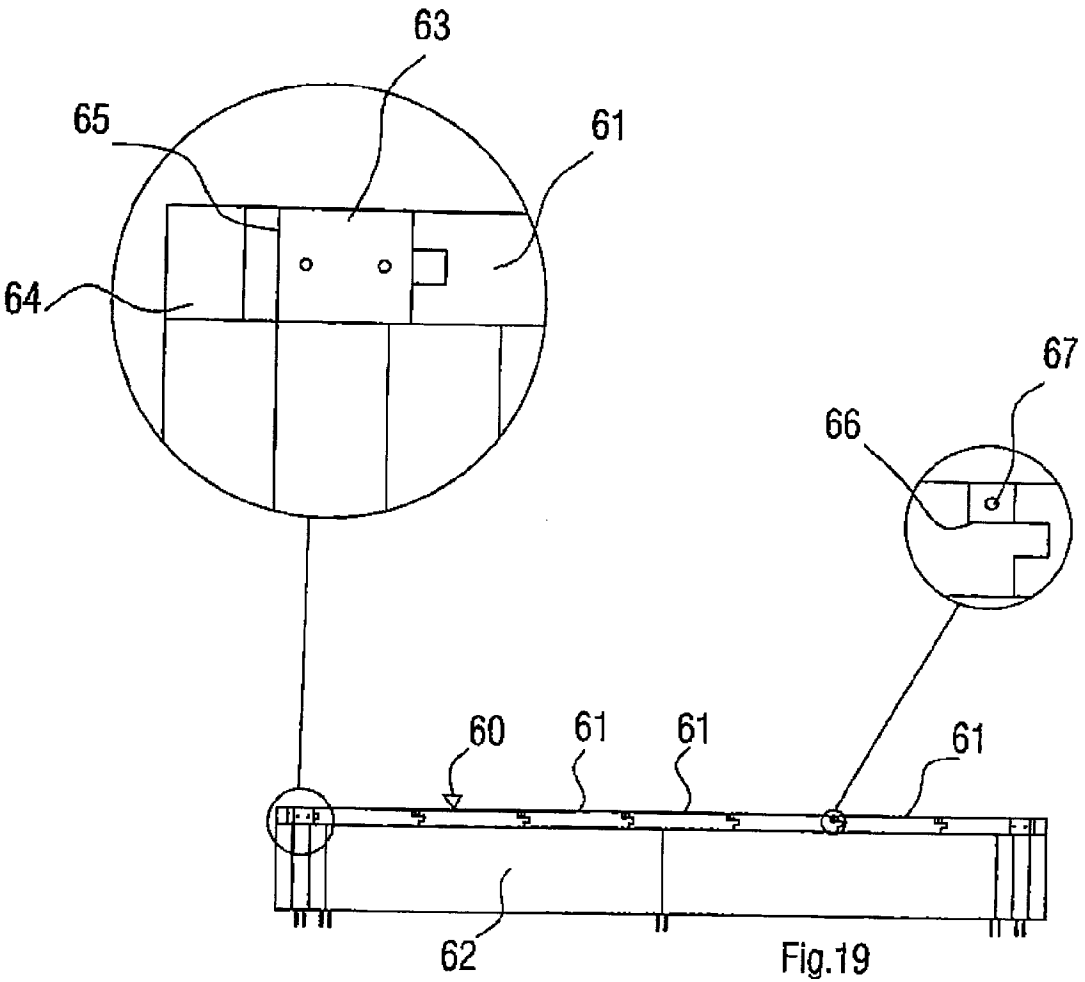
FIG. 19 is an elevational view of a bearing ceiling.
Figure 18:
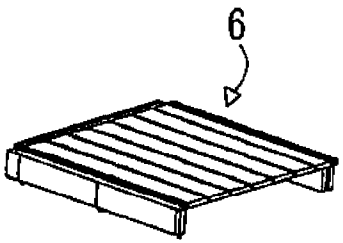
FIG. 18 is a perspective view of a bearing ceiling.
Figure 22:
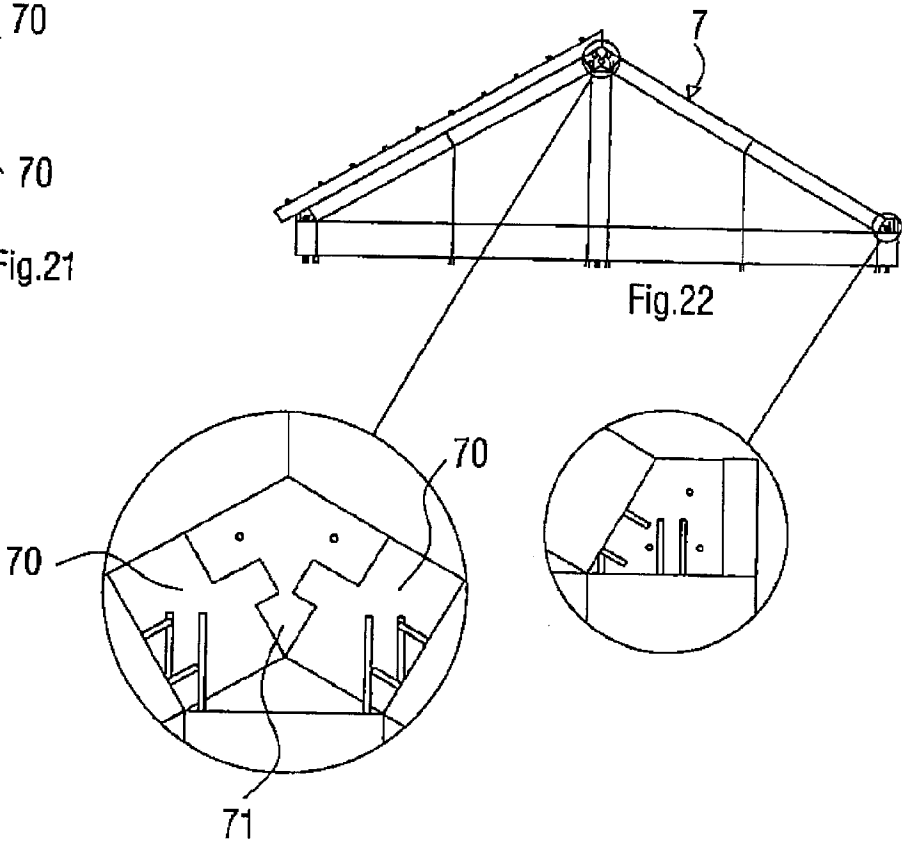
FIG. 22 is an elevational view of the roofing according to FIG. 20.
Figure 21:
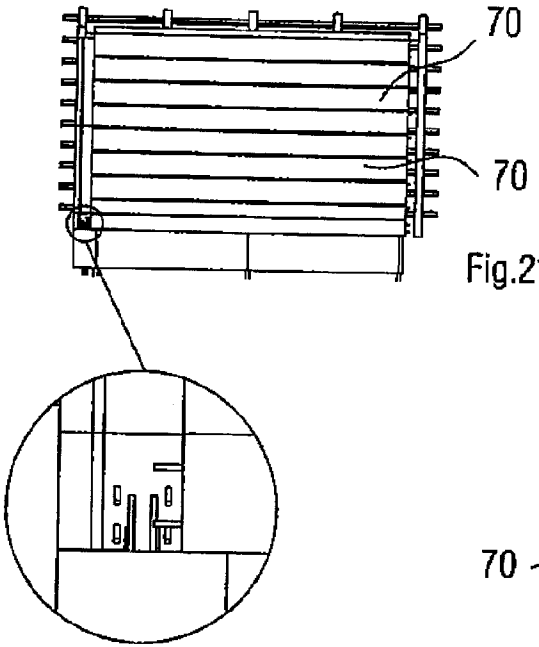
FIG. 21 is a side-face elevational view of the roofing according to FIG. 20.
Figure 20:
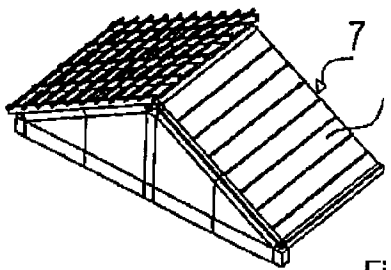
FIG. 20 is a perspective view of roofing for earthquake-prone areas.
Figure 23:
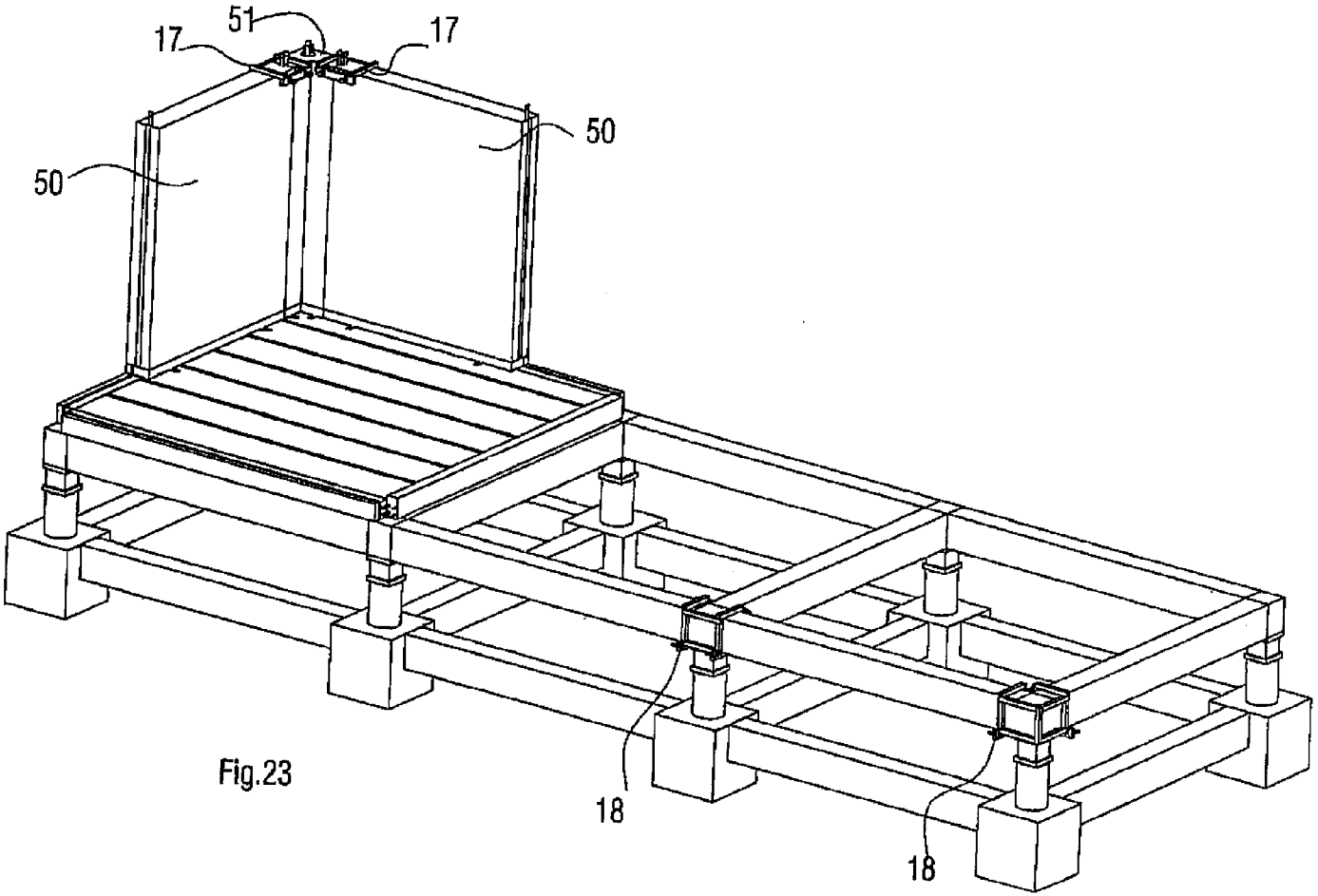
FIG. 23 shows a perspective view of the tools keeping the wall panels vertical and the mold pouring the bonding concrete of the longitudinal ties of the base frame.
Figure 24:
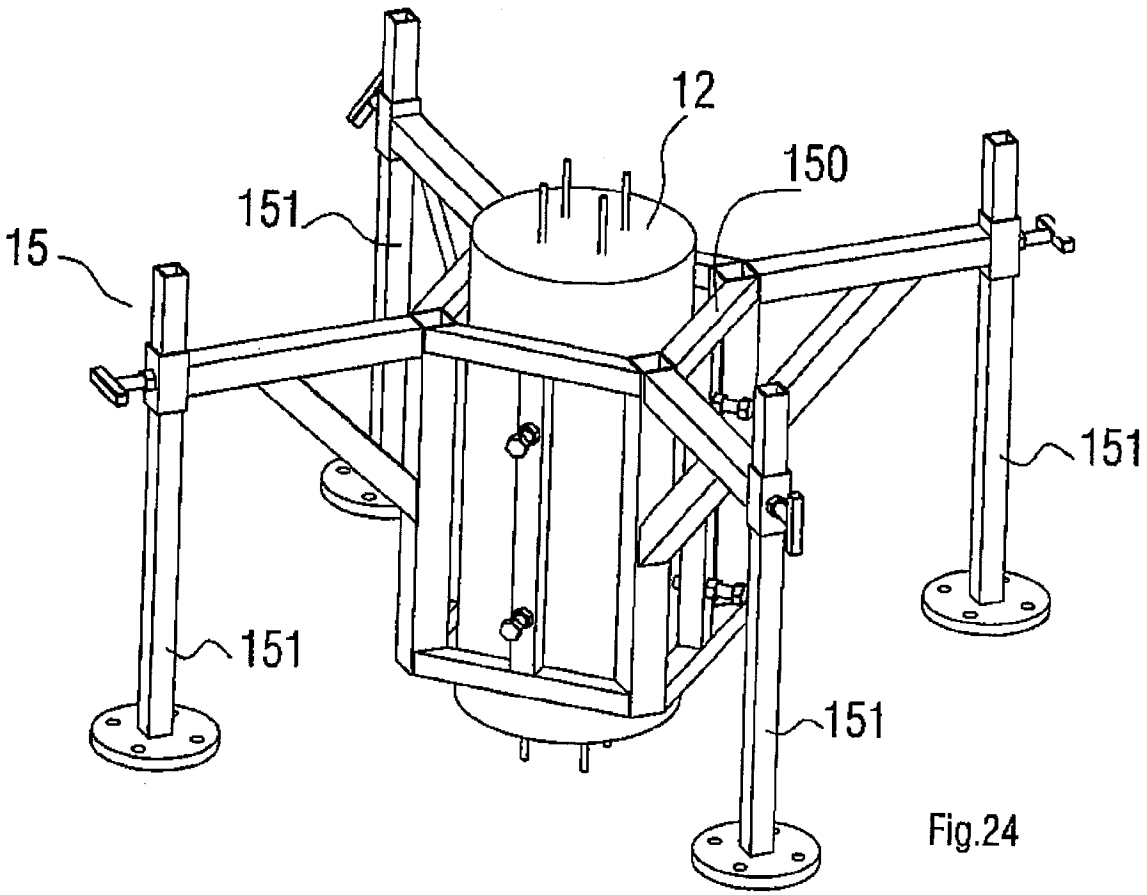
FIG. 24 shows a perspective view of the pillar placing support.
Figure 26:
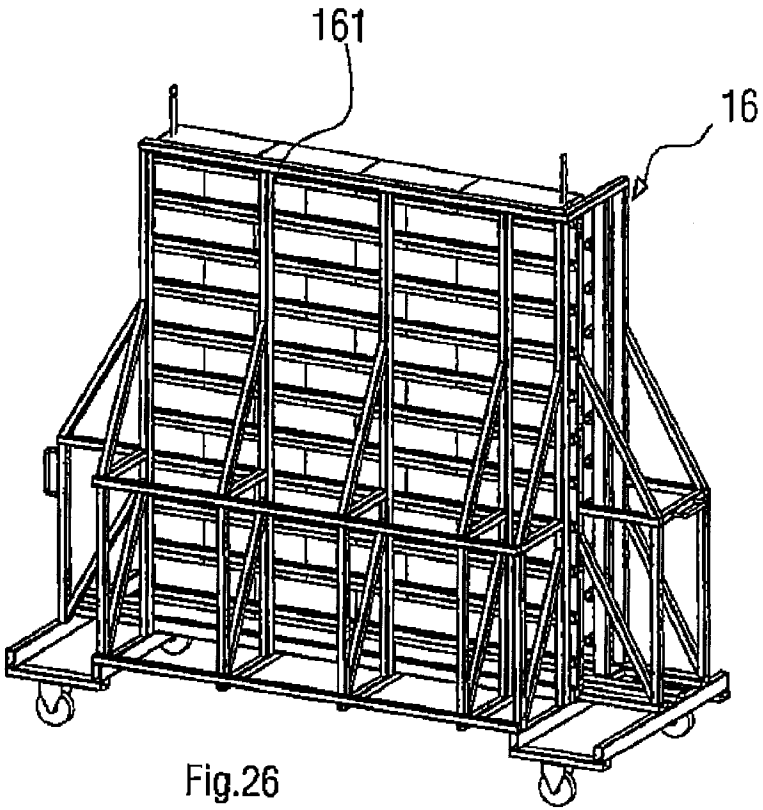
FIGS. 25 and 26 are front and rear perspective views of a wall panel manufacturing jig used for making a facade wall panel.
Figure 25:
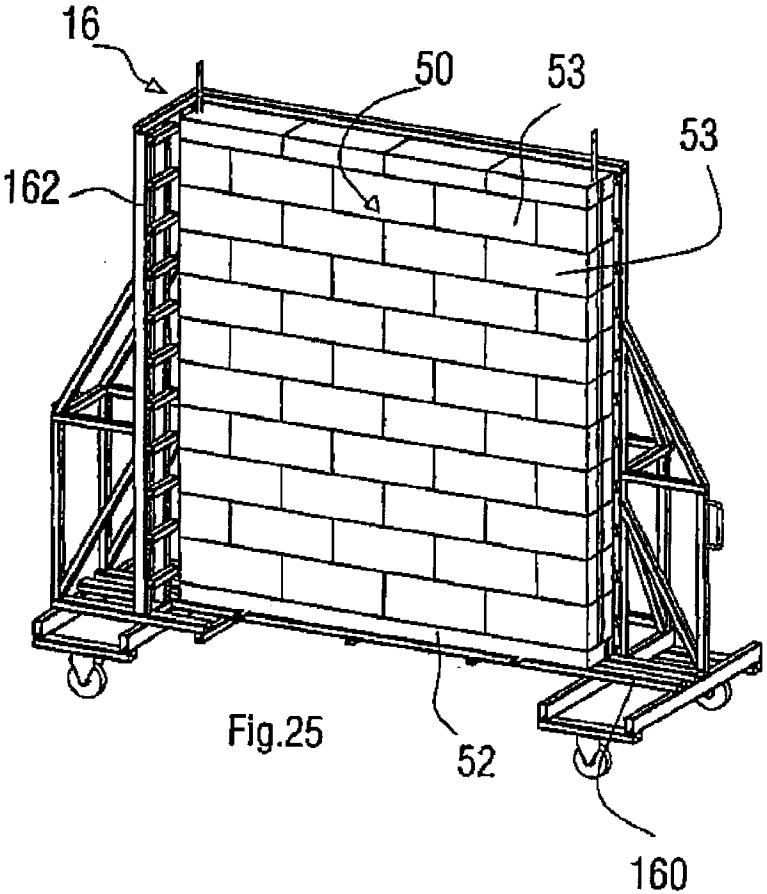
Figure 27:
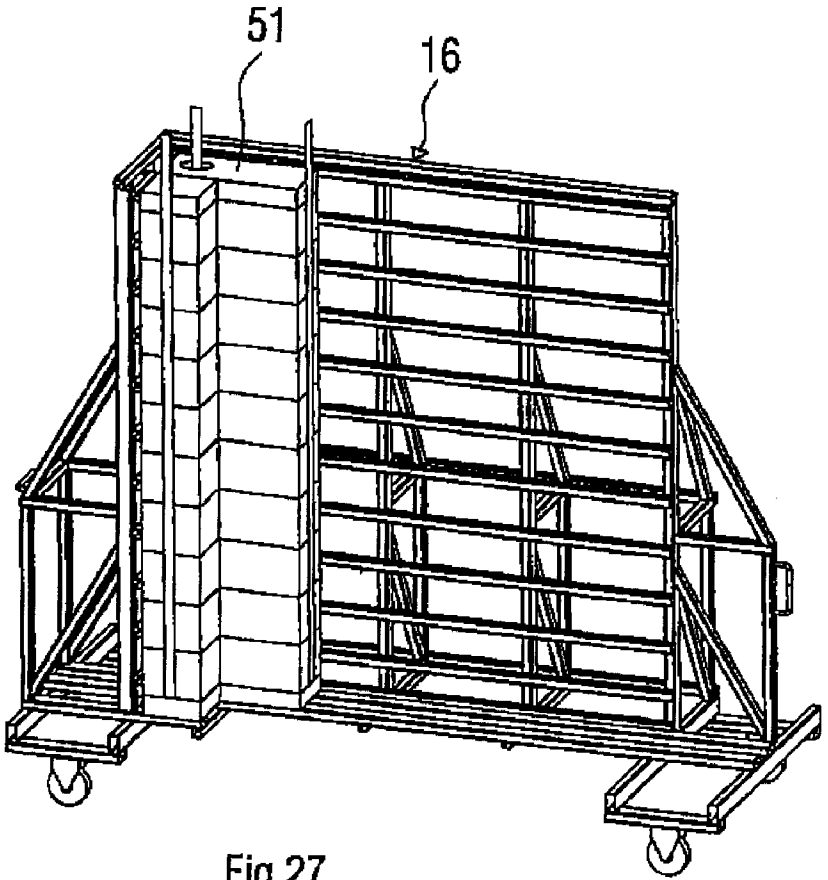
FIG. 27 is a front perspective view of the jig according to FIGS. 25 and 26, used for making an angle wall panel.

The building openings, such as doors, windows or French-windows will be made and equipped in the plant with appropriate framing. In the case of a window 8 (FIG. 13), the rise area of the window support 80 is covered with an appropriate insulating material 81. Against this insulating material, an interior partition 82 is positioned. In the case of a French-window 9 (FIGS. 15 and 16) or of a door, the lintel 90 will be reinforced and the reinforcement of the lintel 90 will penetrate into the lateral anchorage channels 55 to be taken up by the vertical anchorages. This lintel will be created by blocks with a U profile presenting an anchorage recess into which the afore-mentioned armature is inserted and then concrete is poured.

On the upper anchorage connecting the wall panels 50, 51 with each other, a ceiling 6 is installed which consists of a slab 60 formed by assembly of plates 61 of the same type as those used for the floor. In this way, these self-bearing plates feature each along one of their longitudinal edges a tenon and along the opposing longitudinal edge a mortise. The different plates 61 being connected to each other by fitting the mortises of the ones into the tenons of the others. The slab 60 rests on a frame 62 created by abutment of appropriate elements of low height, and it is connected to this frame by an anchorage 63 which is associated with inner partition elements 64 which are covered on their inner face with a thermal insulation 65. This arrangement eliminates thermal bridges at the anchorage.

The plates 61 feature perpendicular to their tenon, a longitudinal rebate 66 to receive, upon assembly to an adjacent plate, a reinforcing anchorage made of concrete and a re-bar 67 in lateral overlap to be taken up in the horizontal peripheral anchorage of the ceiling 6.

The self-bearing roofing 7, known as such, is formed by assembly by glueing along their lateral edge of prefabricated, self-bearing roofing plates 70, the roofing slab being mechanically connected to the anchorage of the floor and to an anchorage formed along the upper faces of the gable walls.

The roofing will be equipped with a ridge anchorage. Also, on the periphery of each roof slope an anchorage can be created, the ridge anchorage constituting the upper segment of the latter.

Finally the various anchoring of the building are tied together to form a rigid framework without any point of discontinuity.

Figure 28:
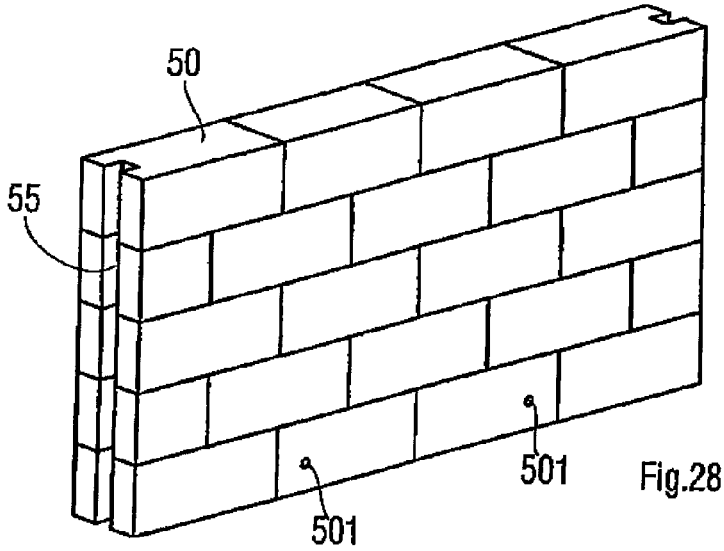
FIG. 28 is a perspective view of a panel presenting a reduced height.

According to another form of execution, such as shown in FIG. 28, the wall panels 50 are of a lesser height and have no bottom footing. For example, the height of such panels will be around 1.50 meters.

The advantages of such an arrangement are multiple. It facilitates in particular the handling operations of such panels 50 and this present also increased stability in comparison with panels of greater height, thereby limiting as much the danger of capsizing on the construction site as well as the danger of accidents.

Figure 29:
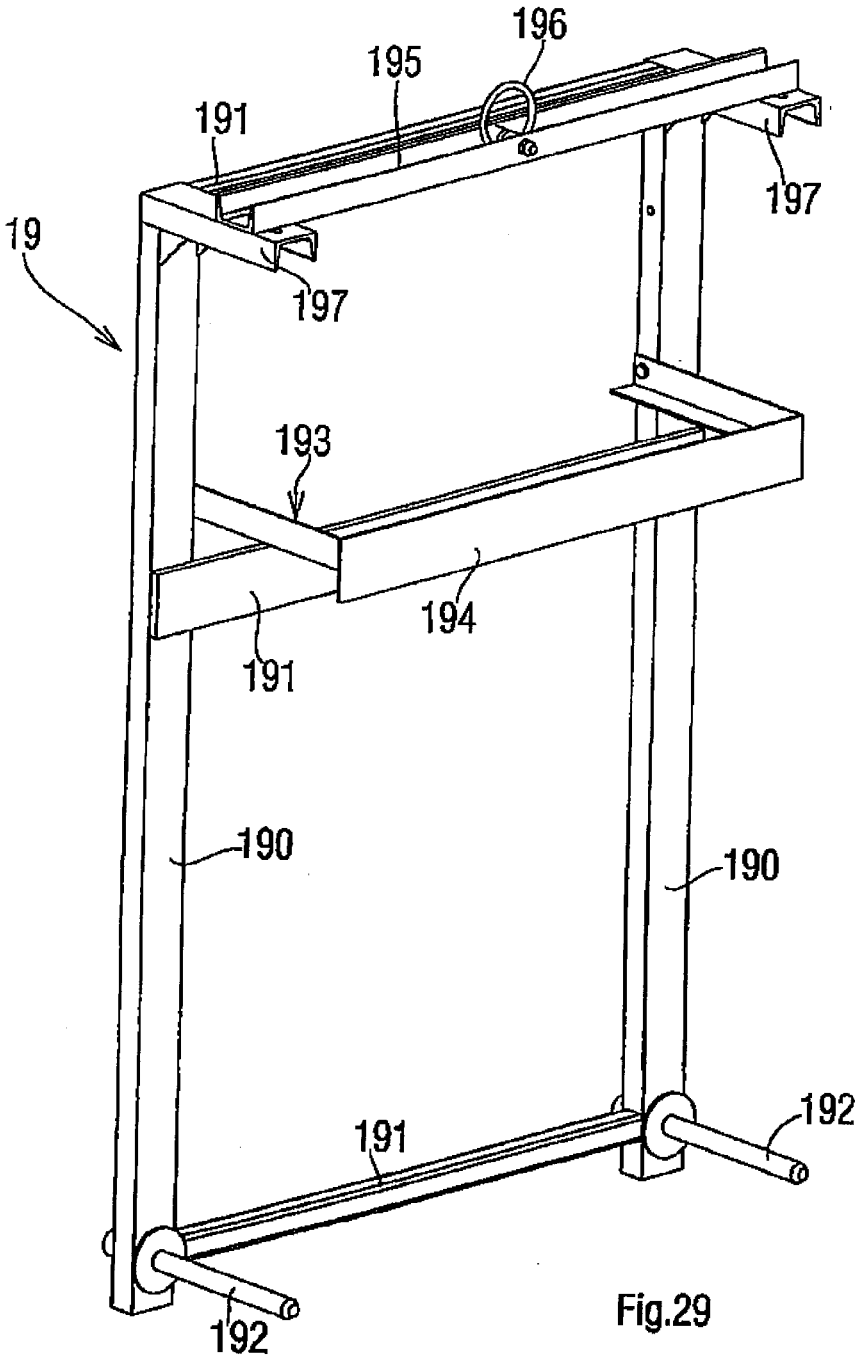
FIG. 29 is a perspective view of a handling device for low height wall panels.
Figure 30:
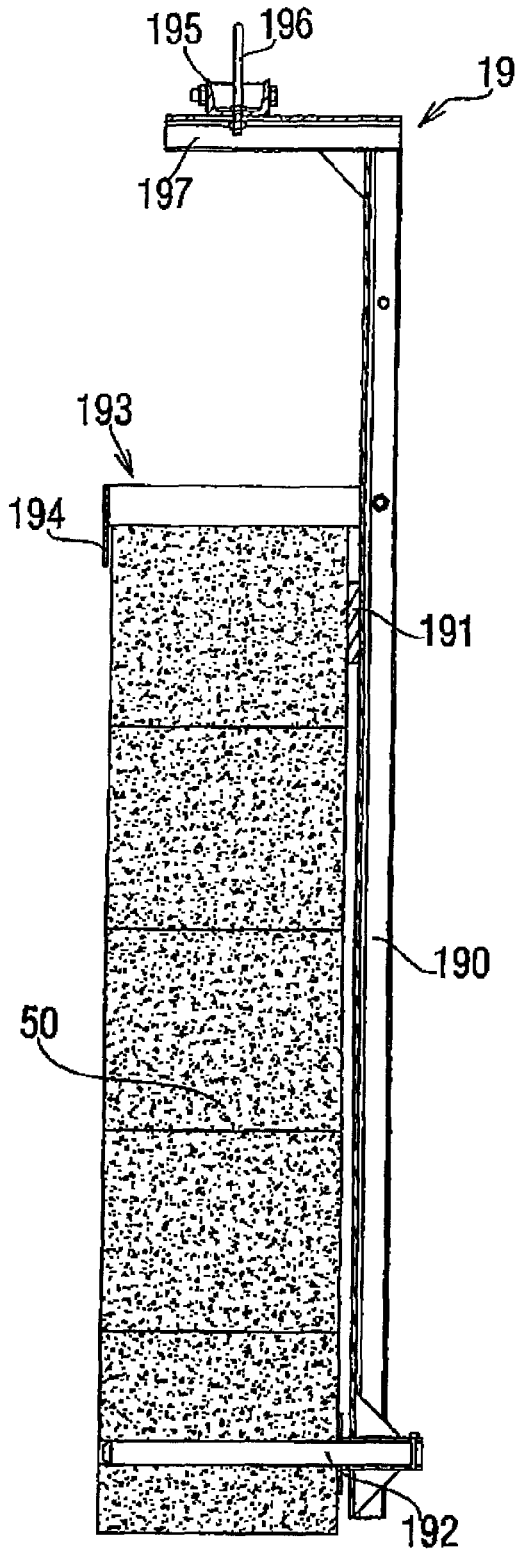
FIG. 30 is a sectional view of a handling device according to FIG. 29, the wall panel being placed on said device.

FIGS. 29 and 30 show a handling device 19 for such wall panels. This device 19 is constituted by 2 vertical columns 190, connected by horizontal cross-members 191. Each column features, at its lower end, a horizontal drift pin 192, support, which is meant to be engaged in a drilled hole 501 in the wall panel 50 to be handled. This handling device 19 comprises furthermore a holding structure 193 that is articulated to the two columns 190 and can be folded down on the wall panel 50. The holding structure 193 is equipped with a hook element 194 that comes in front of the wall panel 50 to keep it stable against the columns 190. Finally the device 19 includes a lifting cross-member 195 with an eye bolt 196, this cross-member being mounted on two horizontal upper arms 197 that are rigidly attached to the columns 190. The lifting cross-member 195 is placed perpendicular to the position of the center of gravity of the wall panel 50 when the panel is in place in the device 19. In order to be able to adjust the position of this lifting cross-member and more precisely the position of the eye bolt 196 relative to this center of gravity, the horizontal upper arms 197 are each provided with an oblong through-hole. The cross-member is fastened to the arms by bolts, the shaft of their threaded part being engaged in the through-hole of the corresponding arm. Adjustment is made by moving the cross-member along the arms.

Figure 31:
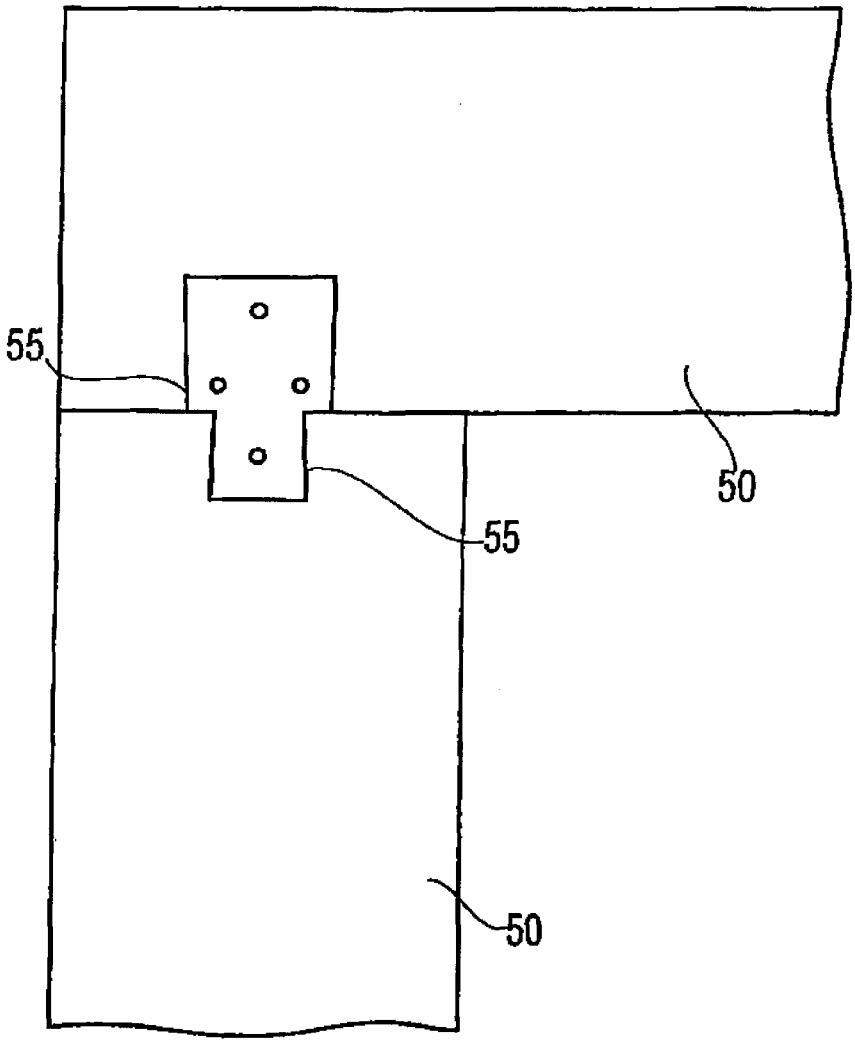
FIG. 31 is a cross-sectional view of a drawing showing the joint of two panels forming one of the angles of the construction.
Figure 32:
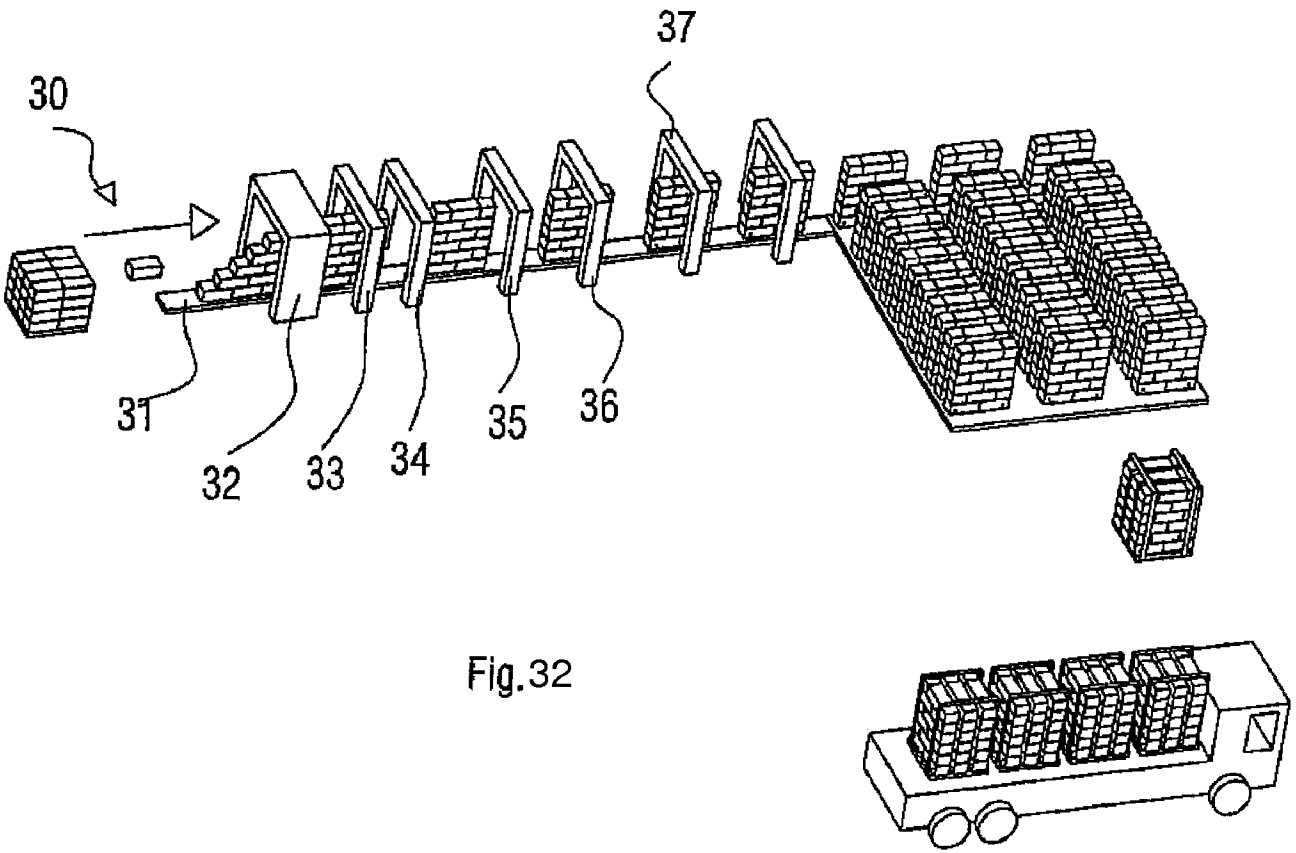
FIG. 32 is a perspective view of an automatic continuous manufacturing installation for wall panels.

According to another form of execution, as shown in FIG. 31, the corners of the building are no longer formed by corner panels 51, but by wall panels 50 with the vertical edge of one panel coming to bear on the large internal face of the other panel. This vertical edge and this large face featuring each a vertical groove matching up with the other groove so as to form a space for vertical anchorage in which a metal reinforcement will be placed and a bonding concrete will be poured.

The installation of the wall panels 50 is made from one corner of the building to another corner of this building. The accumulation of the dimensional tolerances can be such that the two grooves 55 of the panels forming the last corner of the building are unable to match up with each other. To eliminate such a risk which would deprive the corner of the building of its vertical anchorage, one of the two grooves 55 is wider than the other. In this way, the narrower groove 55 will always be matching up with the wider groove. These two grooves 55 may feature a cross-section in dovetail shape, a square or rectangular cross-section.

For the execution of facade and corner panels, an installation jig 16 will be used which features at least one lower plane suspension face 160, for reference, a plane dorsal face 161 for reference perpendicular to the preceding one and at least one plane lateral face 162 for reference by alignment, perpendicular to the two preceding ones. The prefabricated footing of the panel is placed on the lower face 160 against the dorsal wall 161 and against the lateral sidewall 162. The different rows of blocks rest by the dorsal face of the blocks against the dorsal face of the jig, the first block of each row resting also against the lateral face 162 of the jig.

The jig 16 will also be equipped with running gear for easy movement on the ground.

On this jig will be assembled by glueing, on at leas three of their faces, the different building blocks 53 that make up the wall panel. It should be noted that the assembly of the blocks to each other is made by glueing thin joints thereby reducing the thermal bridges.

The anchorage wells which are contained in at least the corner panels will be obtained by alignment of through-holes drilled in the building blocks.

The wall panels 50, 51 built with these jigs 16 will then be checked for their geometry and cut to adequate dimensions along their vertical edges using an appropriate cutting instrument equipped with a cutting head guided by sliding rails and containing a cutting tool of the circular saw type for instance. Such an arrangement is favorable for obtaining a high degree of precision in the geometry of the panel as well as in its dimensions. Thus, the degree of precision from wall to wall will be in the range of a millimeter. It should be noted that the cutting planes can be perpendicular to the large faces of the panels or oblique relative to these faces, since the cutting head is adjustable. Such an oblique cutting position allows the creation of housing angles that are different from a right angle.

The different anchorage grooves as described will be machined in the panels.

The wall panels 50 can also be made continuously with an appropriate manufacturing installation. Such an installation is shown in FIG. 31. This installation 30 includes a mobile linear conveyor 31 facing a station 32 where blocks are placed in juxtaposed rows and assembled by glueing, a height calibration station 33, a wall panel cutting station 34, a lateral grooving station 35, an angle grooving station 36 and a station 37 where panel are drilled for their handling.

The face of the wall is built on the linear conveyor. The latter is of any known type.

The purpose of the height calibration station is to ensure either by cutting or abrasion that the different panels are of equal height.

The panel cutting station will be equipped with a cutting head with a cutting blade of the circular type for instance. This cutting head will be guided by vertical slide rails and will be adjustable by pivoting around a vertical axis in order to achieve cuts along a plane that is perpendicular to one of the large faces of the wall panel or along a plane forming an acute or obtuse angle.

The purpose of the grooving stations 35 and 36 is to make the anchorage grooves in the panel.

The purpose of the panel drilling station is to make in the lower row of blocks of each panel at least one drilled hole 501 through the thickness of said panel.

From the inside faces in the wall panels or only in certain ones of these, different cuts will also be made to accommodate the different energy conduits such as electric conduits to hold the electric cables, gas lines, water pipes and waste water drain pipes. Each cut will be dedicated to one particular type of conduit and the different cuts made in the wall panel will be made at a certain distance from each other so as to ensure the physical separation of the various conduits. Furthermore, an electrical separation will also be achieved because of the electrically insulating nature of the building blocks forming the wall panel.

The wall panel will be advantageously equipped in the plant with the different energy and wastewater drain conduits as well as with the majority of installations associated with these conduits. Thus, the panel for the electrical equipment will be pre-wired, therefore being equipped with electric sockets and switches, control panels etc.

Prior to the installation of equipment associated with the conduits, the wall panel will receive a facing sheet to ensure the covering of the inside face of the wall panel. The cuts and the conduits contained in them are thus protected by this facing sheet. Such an arrangement avoids the use of coatings and other products usually applied for filling up the cuts.

The facing sheet will be advantageously attached to the panel in a non-permanent way, so that it can be removed, if necessary, for easy access to the conduits contained in the panel.

Preferably this facing sheet will be attached by stapling.

It should be noted that this facing sheet advantageously complements the insulation properties of the wall panel. It should also be noted that this facing sheet presents a finished inside face that is ready to be painted, plastered or covered with wallpaper.

It becomes clear that panels are delivered to the construction site that are to a large extent equipped with the interior works which translates into significant time and labor savings.

On the site, the electric wiring contained in the wall panels will be connected to appropriate terminal blocks, advantageously placed in the attic of the building. With respect to the gas, water and wastewater systems that may be contained in the panel, they can be connected to conduits of the same type located in the crawl space between the ground and the base or may be under the floor plates that the floor is equipped with.

For keeping the wall panels upright during their installation and in order to avoid their warping, removable clamps 17 placed on the upper part and this on both sides of the joining faces as well struts will be used to ensure the panels are kept upright.

Removable forms 18, including vertical form partitions and removable clamps will be used for pouring concrete between the longitudinal ties of the base frame.

Finally, the different building blocks and the different plates used for the construction will be made of cellular autoclave concrete.

The advantage of using concrete of this type is manifold. In effect, it has a mechanical strength that is at least equal to other materials but in addition to that its low density in the range of 400 kg/m$^3$ greatly facilitates the handling of the completed panels. The low weight of the panels will result in lower inertia of the latter which is always an advantage for buildings that may be susceptible to earthquakes. Another advantage of a low weight is that it has a favorable influence on the cost of transportation.

This concrete also features a high level of sound and thermal insulation so that the panels produced with it will have these characteristics. Finally, once it is dry, this type of concrete can easily be machined. It will thus be easy to make cuts, grooves and cutouts in every wall panel.

Another asset in the utilization of such a material is that it allows the evacuation of water vapor because of the very favorable value of resistance to the diffusion of water vapor. Therefore the finished walls breathe and contribute the quality of ambient air of the residential units.

Such a material is known particularly under the commercial name of Thermopierre™ or thermostone.

It should be noted that the glue used to bond the blocks between themselves as well as the panels and other elements has, after it has dried, a mechanical strength that is superior to that of the material the blocks are made of.

For placement of the prefabricated pillars 12, an adjustable placement support 15 is preferably used which includes a pillar holding structure 150 in the form of a sheath. The structure is mounted on at least three feet the height of which is individually adjustable. The structure of the sheath 150 will be constituted for example by parallel steel jackets that are inter-connected by posts, some of which include through-screws 152 that press against the pillar 12 in order to ensure its (vertical) retention inside the structure.

With such a device it is possible to position the pillars 12, by their upper face all at the same height and in a coplanar manner.

Preferably the pillars 12 will be positioned on the site before the foundation blocks and longitudinal ties above the trenches made for pouring of the blocks.

It goes without saying that the present invention may accept any arrangements and variants in the area of technical equivalents without thereby leaving the framework of the present patent.

I claim:

1. A building assembly comprising:

a foundation;

a base supported upon said foundation;

a plurality of walls erected upon said base;

a ceiling resting at an upper end of said plurality of walls opposite said base; and a roof resting at an upper end of said plurality of walls opposite said base, said foundation formed of a plurality of foundation blocks connected by longitudinal ties, said plurality of foundation blocks and said longitudinal ties being poured on site and arranged in a quadrangular grid having rows and columns that are perpendicular to each other, said plurality of foundation blocks positioned at an intersection of the rows and columns, each of said plurality of foundation blocks having a vertical pillar rigidly affixed thereto and extending upwardly respectively therefrom, the vertical pillars having a horizontal upper planar face formed in a common horizontal plane, said base supported by the upper planar faces, said base having a base frame arranged in a grid and a floor resting on said base frame and rigidly fastened thereto, said base having prefabricated pre-stressed tie beams resting on respective ends in the vertical pillars and fastened thereto and a floor having plates arranged in a grid, said grid having an anchorage rigidly attached to said plates and to said base.

2. The building assembly of claim 1, further comprising:

an isolating means positioned between said base and the vertical pillars, said isolating means for absorbing seismic energy.

3. The building assembly of claim 1, said base being rigidly attached to the vertical pillars.

4. The building assembly of claim 1, said grid of said base frame and said grid of said floor communicating with each other.

5. The building assembly of claim 1, said grid of said base frame having rows and columns, the vertical pillars positioned at the intersections of said rows and columns of said base frame.

6. The building assembly of claim 1, said plates being juxtaposed together in said grid and linked together.

7. The building assembly of claim 6, each of said plates having a receptacle along a longitudinal edge thereof, said receptacle receiving a reinforcing and connecting anchorage therein.

8. The building assembly of claim 7, said reinforcing and connecting anchorage being a rod extending over the longitudinal tie and connected to said anchorage of said grid of said floor.

9. The building assembly of claim 6, the plate having one edge of a tenon shape and another edge of a mortise shape.

10. The building assembly of claim 1, said floor having inner partitions, said inner partitions being covered with a thermal insulation on an inside face thereof.

11. The building assembly of claim 1, each of said vertical pillars having a vertical reinforcement extending outwardly of said upper planar face.

12. The building assembly of claim 1, said plurality of walls being in abutment and being assembled together.

13. The building assembly of claim 1, each of said plurality of walls having a facade of a planar shape.

14. The building assembly of claim 1, said plurality of walls having corner panels each of a dihedral shape.

15. The building assembly of claim 1, each of said plurality of walls having a rigid horizontal bottom footing, each of said plurality of walls having an internal reinforcement that is mechanically connected to a compression plate.

16. The building assembly of claim 15, said bottom footing being formed of reinforced concrete, each of said plurality of walls being formed by an assembly of building blocks on said bottom footing.

17. The building assembly of claim 12, said plurality of walls being assembled on said floor by adherence and by friction.

18. The building assembly of claim 17, each of said plurality of walls having a bottom edge glued to said floor.

19. The building assembly of claim 17, said plurality of walls having mating surfaces, said mating surfaces having a reinforcements that are mechanically assembled together, said plurality of walls having vertical abutting edges that are glued together.

20. The building assembly of claim 17, said plurality of walls being assembled together in an upper portion thereof by a contiguous horizontal anchorage engaged with protruding reinforcing elements on upper edges of said plurality of walls.

21. The building assembly of claim 17, said plurality of walls having a continuous vertical groove in a vertical lateral edge thereof extending over an entire height of the wall.

22. The building assembly of claim 21, the continuous vertical grooves of adjacent walls of the plurality of walls receiving a bonding concrete therein.

23. The building assembly of claim 17, said plurality of walls having a corner panel, said corner panel having a vertical cylindrical wall receiving a reinforcing bar therein.

24. The building assembly of claim 17, at least one of said plurality of walls having a vertical cutout.

25. The building assembly of claim 17, each of said plurality of walls having an inside face covered by a removable face sheet.

26. The building assembly of claim 17,each of said plurality of walls having at least one through-hole formed through a thickness thereof.

27. The building assembly of claim 1, said ceiling being formed by a juxtaposition of plates attached together by an anchorage in a grid pattern.

28. The building assembly of claim 1, said ceding being formed by an assembly of ceiling plates, each of said ceiling plates having a fitting tenon on one longitudinal edge of a fitting mortise on an opposite longitudinal edge.

29. The building assembly of claim 28, each of said ceiling plates having a receptacle arranged perpendicular to said fitting tenon.

30. The building assembly of claim 1, said roof having a plurality of roofing plates glued together.

31. The building assembly of claim 1, said roof having a framework formed by girders, said ceiling being formed from plaster plates suspended from said framework.

32. The building assembly of claim 17, said plurality of walls defining a corner formed by a pair of said plurality of walls in which a vertical edge of one of the walls bears against an internal face of another of the walls, said vertical edge and said internal face each having a vertical groove.

33. The building assembly of claim 32, one of the vertical grooves having a width that is greater than another of said vertical grooves.

* * * * *